US008173004B2

(12) United States Patent
Hirasawa et al.

(10) Patent No.: US 8,173,004 B2
(45) Date of Patent: May 8, 2012

(54) METHOD OF MANUFACTURING CHROMIUM PLATED ARTICLE AND CHROMIUM PLATING APPARATUS

(75) Inventors: Takahisa Hirasawa, Fujisawa (JP); Hiroshi Yoshikura, Kawasaki (JP); Junichi Ikeda, Tokyo (JP); Tsuyoshi Kawase, Kofu (JP); Yuichi Kobayashi, Sagamihara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/724,783

(22) Filed: Mar. 16, 2010

(65) Prior Publication Data

US 2010/0213072 A1 Aug. 26, 2010

Related U.S. Application Data

(62) Division of application No. 11/235,355, filed on Sep. 27, 2005, now abandoned.

(51) Int. Cl.
*C25D 5/18* (2006.01)

(52) U.S. Cl. ..... 205/104; 205/283; 204/242; 204/272

(58) Field of Classification Search ..... 205/104, 205/283

See application file for complete search history.

(56) References Cited

U.S. PATENT DOCUMENTS

| | | | | |
|---|---|---|---|---|
| 4,588,481 | A | 5/1986 | Chessin et al. | |
| 6,132,584 | A * | 10/2000 | Hubel | 205/103 |
| 6,179,984 | B1 * | 1/2001 | Maurer | 205/104 |
| 6,224,721 | B1 * | 5/2001 | Nelson et al. | 204/272 |
| 6,329,071 | B1 * | 12/2001 | Kobayashi et al. | 428/615 |
| 6,695,961 | B1 * | 2/2004 | Hubel | 205/80 |

FOREIGN PATENT DOCUMENTS

| | | |
|---|---|---|
| GB | 2 236 763 | 4/1991 |
| JP | 63-32874 | 7/1988 |
| JP | 3-207884 | 9/1991 |
| JP | 2000-199095 | 7/2000 |
| JP | 2003-171799 | 6/2003 |
| JP | 2003171799 A * | 6/2003 |

OTHER PUBLICATIONS

Machine Translation of JP 2003-171799A.*

M. Kuramoto, et al., "*Stress Measurement in Electrodeposited Chromium*", Hihakai Kensa edited by the Japanese Society for Non-destructive Inspection, vol. 37, Item 8, pp. 636-642, 1988.

* cited by examiner

*Primary Examiner* — Harry D Wilkins, III
*Assistant Examiner* — Bryan D. Ripa
(74) *Attorney, Agent, or Firm* — Wenderoth, Lind & Ponack, L.L.P.

(57) ABSTRACT

A pulse current from a pulse current supply side is fed to a middle part of an anode holding body to which anodes are connected; both end portions of a cathode holding body, to which cathodes are connected, are connected to a negative pole on the pulse power source side; and inductances of wiring between adjacent anodes and inductances of wiring between adjacent cathodes are set at a ratio of 1:2:3:4 in a direction of spacing from a connection to the pulse power source side. Pulse currents are equally fed to each work and it can be ensured that chromium plating treatment of each work is made equal.

12 Claims, 19 Drawing Sheets

| CONSTITUENT | BLEND AMOUNT (g/L) | |
|---|---|---|
| | SUITABLE | PREFERRED |
| CHROMIC ACID | 100~450 | 200~300 |
| SULFURIC ACID | 1~5 | 1.5~3.5 |
| ORGANIC SULFONIC ACID | 1~18 | 1.5~12 |
| BORIC ACID | 0~40 | 4~30 |

CENTRAL POWER SUPPLY IMBALANCE

METHOD OF MANUFACTURING CHROMIUM PLATED ARTICLE AND CHROMIUM PLATING APPARATUS

This application is a Divisional of U.S. application Ser. No. 11/235,355, filed Sep. 27, 2005 now abandoned, the entire contents of which is hereby incorporated by reference.

BACKGROUND OF THE INVENTION

I. Technical Field

The present invention relates to a method of manufacturing a chromium plated article and a chromium plating apparatus, which can deposit a hard chromium layer on a work surface.

II. Description of the Related Art

In a hard chromium plating treatment for a general purpose, a hard chromium layer is deposited on a work surface. There are disadvantages in the method, in that cracks may appear in the chromium layer which reach a metal substrate, allowing substances which cause corrosion to come in contact with the metal substrate, thereby deteriorating the ability of the plated article to resist corrosion. Therefore, it has hitherto been general practice that selected parts of articles which are exposed to corrosive environments are subjected to a pre-treatment procedure of nickel plating or copper plating so as to form an undercoat having a film thickness of the same extent as the layer of hard chromium plating that is applied subsequently. However, this requires that the plating treatment be carried out twice by using different procedures for a pre-treatment step to create an undercoat and the subsequent step of applying a layer of chromium plating, with the result that there is an increase in manufacturing cost.

On the other hand, it has already been ascertained that a chromium layer free from cracks can be formed by performing what is called pulse plating by use of a pulse current (refer to the Japanese Patent Application Disclosure No. 3-207884 (U.K. Patent Application Disclosure No. 2,236,763), for example). When this method is adopted, it becomes possible to obtain in one treatment step chromium plated parts with excellent corrosion resistance. This chromium treatment which is performed by using a pulse current has the problem that when parts are subjected to a thermal history, large cracks are apt to occur in a chromium layer. Therefore, there has been no other choice than to abandon the application of this chromium treatment to parts subjected to a thermal history.

It might be thought that a tensile stress generated in a chromium layer due to thermal contraction is responsible for the phenomenon that cracks are apt to occur when parts are subjected to a thermal history. It follows, therefore, that the occurrence of cracks can be suppressed by causing a compressive residual stress capable of counterbalancing the above-described tensile stress to be present beforehand in the chromium layer or by suppressing the quantity of thermal contraction of the chromium layer itself. In this case, the thermal contraction of the chromium layer is affected by the quantity of lattice defects which are present in large amounts at the grain boundary of the chromium layer and, therefore, the total amount of the boundary is reduced by increasing the size of crystallites of the chromium layer (the total amount of the boundary is inversely proportional to the size of crystallites), whereby lattice defects are reduced and thermal contraction of the chromium layer can be suppressed.

Paying attention to the above-described point, Yuichi KOBAYASHI, who is one of the present inventors, et al. have ascertained that the above-described occurrence of cracks caused by a thermal history can be prevented by causing a compressive residual stress of not less than 100 MPa to be present in the chromium layer and ensuring the size of crystallites of the chromium layer which is not less than 9 nm on average (however, the upper limit being 16 nm on average), and have already made this fact clear in the Japanese Patent Application Disclosure No. 2000-199095 (U.S. Pat. No. 6,329,071). And Yuichi KOBAYASHI et al. found out that as a method of depositing a chromium layer having such a large compressive residual stress and size of crystallites, it is effective to perform electroplating while adjusting the pulse waveform of a pulse current in a plating bath containing an organic sulfonic acid, and have also made this point clear in the Japanese Patent Application Disclosure No. 2000-199095.

SUMMARY OF THE INVENTION

Incidentally, methods of plating treatment include 'continuous treatment' in which treatment is performed by causing a work to continuously flow within a treatment tank and 'batch treatment' in which multiple works are put in a treatment tank and treated in a batch manner. If a continuous treatment is adopted in performing high-mix low-volume production, other works cannot be treated unless the treatment of one work which is to be treated with a prescribed size and under prescribed conditions is finished. Therefore, much waste is incurred in terms of efficiency and there is no other choice than to rely on batch treatment.

When the chromium plating described in the Japanese Patent Application Disclosure No. 2000-199095 is actually performed in a batch manner, this method had the problem that there are considerable variations in the compressive residual stress and the size of crystallites in an obtained chromium layer even within one lot, with the result that it is difficult to stably obtain works (parts) which meet the above-described compressive residual stress of not less than 100 MPa and size of crystallites of not less than 9 nm on average. Furthermore, when the work length is large, this method had the problem that there are variations in the compressive residual stress and size of crystallites of an obtained chromium layer between a portion near a power supply section and a portion away from the power supply section even in the same work, with the result that it is difficult to stably obtain works (parts) which meet the above-described compressive residual stress of not less than 100 MPa and the size of crystallites of not less than 9 nm on average.

The present invention has been made in view of the above-described problems. It is an object of the present invention to provide a method of manufacturing a chromium plated article and a chromium plating apparatus which enable chromium plated parts in which no crack occurs in a chromium layer as a matter of course, not only at temperatures near room temperature but also in a case where the parts are subjected to a thermal history, to be stably and uniformly obtained by batch treatment. Those skilled in the art can easily understand the other objects of the present invention with reference to the specification and drawings.

The first aspect of the present invention is a method of manufacturing a chromium plated article which includes: immersing a plurality of works in a chromium plating bath; and depositing a chromium layer having a desired compressive residual stress on a surface of each of the works by using a pulse current, wherein a waveform of the pulse current supplied to each of the works is made uniform irrespective of the works by adjusting inductance of a wiring from a pulse power source to each of the works.

The second aspect of the present invention is a method of manufacturing a chromium plated article which includes: immersing a plurality of works in a chromium plating bath;

and depositing a chromium layer having a desired compressive residual stress on a surface of each of the works by using a pulse current; wherein the works are disposed in an apparatus which comprises a plurality of anodes and a plurality of cathodes disposed in such a manner as to correspond to each of the plurality of works, an anode holding body which is connected sequentially to the plurality of anodes and is connected to a positive pole of a pulse power source, and a cathode holding body which is connected sequentially to the plurality of cathodes and is connected to a negative pole of the pulse power source; and wherein chromium plating is performed, with the pulse power source connected to a middle part of one of the anode holding body and the cathode holding body, and the pulse power source connected to both ends of the other.

The third aspect is that in the method of manufacturing a chromium plated article in the second aspect, at least one inductance of the anode holding body and the cathode holding body becomes large with increasing distance from a connection to the pulse power source.

The fourth aspect is that in the method of manufacturing a chromium plated article in the third aspect, inductances between the plurality of electrodes are set at a ratio of 1:2:3: . . . sequentially, in a direction of spacing from the connection to the pulse power source.

The fifth aspect is that in the method of manufacturing a chromium plated article in the second aspect, each of the plurality of anodes is cylindrical, and each of the works connected to the plurality of cathodes is inserted into each of the plurality of anodes.

The sixth aspect is that in the method of manufacturing a chromium plated article in the second aspect, each of the works is arranged in one row at a prescribed spacing, and the anodes are disposed in a plurality of pairs in a face-to-face relation, with each of the works interposed therebetween.

The seventh aspect is that in the method of manufacturing a chromium plated article in the sixth aspect, the anode holding body includes a first anode holding part on one side and a second anode holding part on the other side, and the plurality of anodes includes a first anode group on one side and a second anode group on the other side, the first anode holding part on one side and the second anode holding part on the other side are respectively provided in positions below or above the first anode group on one side and the second anode group on the other side, and the plurality of cathodes are provided in positions below or above the works.

The eighth aspect is that in the method of manufacturing a chromium plated article in the sixth aspect, the inductance between the plurality of cathodes of the cathode holding body is twice as large as the inductance between the plurality of anodes of the anode holding body.

The ninth aspect of the present invention is a chromium plating apparatus which immerses a plurality of works in a chromium plating bath and deposits a chromium layer having a desired compressive residual stress on a surface of each of the works by using a pulse current, wherein inductance of a wiring from a pulse power source to each of the works is set so that a waveform of the pulse current supplied to each of the works is made uniform irrespective of the works.

The tenth aspect of the present invention is a chromium plating apparatus which immerses a plurality of works in a chromium plating bath and deposits a chromium layer having a desired compressive residual stress on a surface of each of the works by using a pulse current. This chromium plating apparatus comprises: a plurality of anodes and a plurality of cathodes disposed in such a manner as to correspond to each of the plurality of works; an anode holding body which is connected sequentially to the plurality of anodes and is connected to a positive pole of the pulse power source; and a cathode holding body which is connected sequentially to the plurality of cathodes and is connected to a negative pole of the pulse power source, wherein the pulse power source is connected to a middle part of one of the anode holding body and the cathode holding body, and the pulse power source is connected to both ends of the other.

The eleventh aspect of the present invention is that in the chromium plating apparatus in the tenth aspect, at least one inductance of the anode holding body and the cathode holding body becomes large with increasing distance from a connection to the pulse power source.

The twelfth aspect of the present invention is that in the chromium plating apparatus in the eleventh aspect, inductances between the plurality of electrodes are set at a ratio of 1:2:3: . . . sequentially in a direction of spacing from the connection to the pulse power source.

The thirteenth aspect of the present invention is that in the chromium plating apparatus in the tenth aspect, each of the plurality of anodes is cylindrical, and each of the works connected to the plurality of cathodes is inserted into each of the plurality of anodes.

The fourteenth aspect of the present invention is that in the chromium plating apparatus in the tenth aspect, each of the plurality of works is arranged in one row at a prescribed spacing, and the anodes are disposed in a plurality of pairs in a face-to-face relation, with each of the works interposed therebetween.

The fifteenth aspect of the present invention is that in the chromium plating apparatus in the fourteenth aspect, the anode holding body includes a first anode holding part on one side and a second anode holding part on the other side, and the plurality of anodes includes a first anode group on one side and a second anode group on the other side, the first anode holding part on one side and the second anode holding part on the other side are respectively provided in positions below or above the first anode group on one side and the second anode group on the other side, and the plurality of cathodes are provided in positions below or above the works.

The sixteenth aspect of the present invention is that in the chromium plating apparatus in the fourteenth aspect, the inductance between the plurality of cathodes of the cathode holding body is twice as large as the inductance between the plurality of anodes of the anode holding body.

In each of the aspects of the present invention, it is possible to perform energization in such a manner that pulse currents supplied to works are applied by adjusting of a wiring from the pulse power source to each of the works, whereby the pulse currents applied to each of the works are made approximately equal to each other, and eventually, it becomes possible that each of the works can be subjected to chromium plating treatment evenly.

DETAILED DESCRIPTION OF THE INVENTION

A batch chromium plating method and apparatus in the first embodiment of the present invention will be described below on the basis of FIGS. 1A to 1C to FIG. 5.

In FIGS. 1A to 1C and FIG. 2, a chromium plating apparatus 1 has a batch treatment tank 2 fabricated from an electrically insulating material, and the tank 2 houses a plating bath containing an organic sulfonic acid. In this tank 2, ten works W (W1 to W10) are immersed in the chromium plating bath and a chromium layer having a desired compressive residual stress is deposited on each of the surfaces of the works W by use of a pulse current from a pulse power source 3. In the batch treatment tank 2, a plurality of cylindrical anodes Y are arranged in a row at a prescribed spacing in such a manner as to correspond to the works W. Above the anodes Y, cathodes K are arranged so as to correspond to the anodes Y. The works W are inserted into the anodes Y so as to face the inner circumferential walls of the anodes Y.

Hereinafter, the plurality of anodes Y are called the first, second, . . . tenth anodes Y1, Y2, . . . Y10 in order from the left of FIG. 1A. The cathodes K are called the first, second, . . . tenth cathodes K1, K2, . . . K10 in order from the left of FIG. 1B.

Figure 1A:
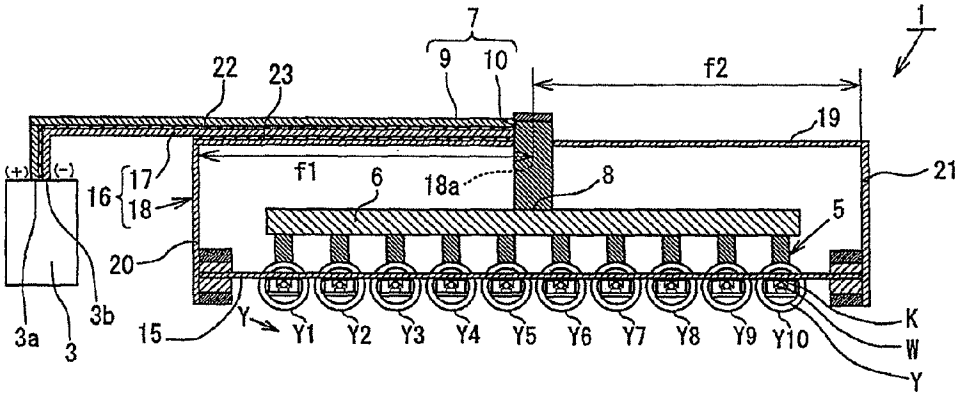
FIG. 1A is a plan sectional view which schematically shows a chromium plating apparatus in the first embodiment of the present invention.
Figure 1B:
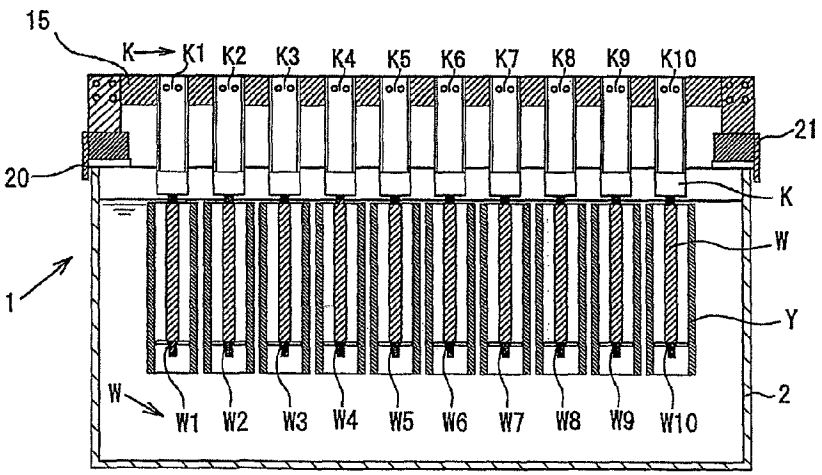
FIG. 1B is a front sectional view which schematically shows a chromium plating apparatus in the first embodiment of the present invention.
Figure 1C:
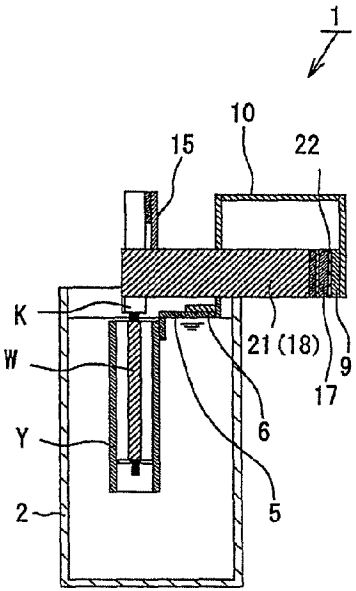
FIG. 1C is a side sectional view which schematically shows a chromium plating apparatus in the first embodiment of the present invention.

As shown in FIGS. 1A and 1C, the anodes Y are connected to a plate-like anode holding body 6 via hook members 5 which are equally spaced. The anode holding member 6 is connected, in a middle part thereof, to a positive pole terminal 3*a* of the pulse power source 3 via an anode-side bus bar 7 (hereinafter, this connection is called a power supply point 8). The anode-side bus bar 7 is constituted by a roughly L-shaped, plate-like anode-side bus-bar main body 9, one end portion of which is connected to the positive pole terminal 3*a* of the pulse power source 3, and an anode-side bus-bar extension plate 10, one end portion of which is connected to the other end portion of the anode-side bus-bar main body 9, and the other end portion of the anode-side bus-bar extension plate 10 is connected to a feeding point 8 of the anode holding body 6.

As shown in FIGS. 1B and 1C, the cathodes K are connected to a plate-like cathode holding body 15 disposed above the batch treatment tank 2. The cathode holding body 15 is connected, at both end portions thereof, to a negative pole terminal 3*b* of the pulse power source 3 via a cathode-side bus bar 16. The cathode-side bus bar 16 is constituted by a roughly L-shaped, plate-like cathode-side bus-bar main body 17, one end portion of which is connected to the negative pole terminal 3*b* of the pulse power source 3, and a roughly Π-shaped cathode-side bus-bar extension portion 18 connected to the other end portion of the cathode-side bus-bar main body 17.

The cathode-side bus-bar extension portion 18 is constituted by a plate-like extension-portion main body 19 and orthogonal plates provided consecutively in both end portions of the extension-portion main body 19 (for the sake of convenience, the left-hand one in FIG. 1B is hereinafter called a first orthogonal plate 20 and the right-hand one in FIG. 1B is called a second orthogonal plate 21), and the first and second orthogonal plates 20, 21 are respectively connected to end portions of the cathode holding body 15.

The anode-side bus-bar main body 9 and the cathode-side bus-bar main body 17 are disposed by being mutually superposed via an insulating member 22 as near to each other as possible, and it is ensured that the inductance becomes small as a result of the flow of currents in reverse directions and in other cases. The portion of the first orthogonal plate 20 in the extension-portion main body 19 is joined to the other end portion side of the cathode-side bus-bar main body 17 via an insulating member 23.

A current supplied from the pulse power source 3 is fed to the feeding point 8 via the anode-side bus bar 7 and then fed to the anodes Y (the first, second, . . . tenth anodes Y1, Y2, . . . Y10) disposed within the batch treatment tank 2 via the anode holding body 6. Furthermore, the current forms a coating layer on each of the works W via a plating solution, flows to the cathodes K (the first, second, . . . tenth cathodes K1, K2, . . . K10) via the works W, and returns to the pulse power supply source 3 via the cathode-side bus bar 16. In the process of flow of currents as described above, a current supplied to the feeding point 8 is divided and sent to each of the anodes Y from the feeding point 8 and flows through each of the works. The current which has flowed to each of the works W flows toward both end sides of the cathode holding body 15. By paying attention to the fact that currents flow in the above-described manner, in this embodiment, as shown in FIGS. 1A to 1C and FIG. 2, each inductance between adjacent anodes Y (the wiring portions between the adjacent anodes Y in the anode holding body 6 and the hook member 5 are taken into consideration) and each inductance between the adjacent cathodes K (the wiring portions between adjacent cathodes K in the cathode holding body 15 are taken into consideration) are set at an equal value (in this embodiment, 0.08 μH).

Incidentally, inductance of an electrode is composed of self-inductance and mutual inductance. It is known that self-inductance is determined by a material (magnetic permeability) and shape (length, thickness; sectional area) of an electrode and mutual inductance is affected by spacing between adjacent electrodes. In this embodiment, each of the above-described inductances is set at an equal value by adjusting the factors and influential items for determining the inductances.

Figure 2:
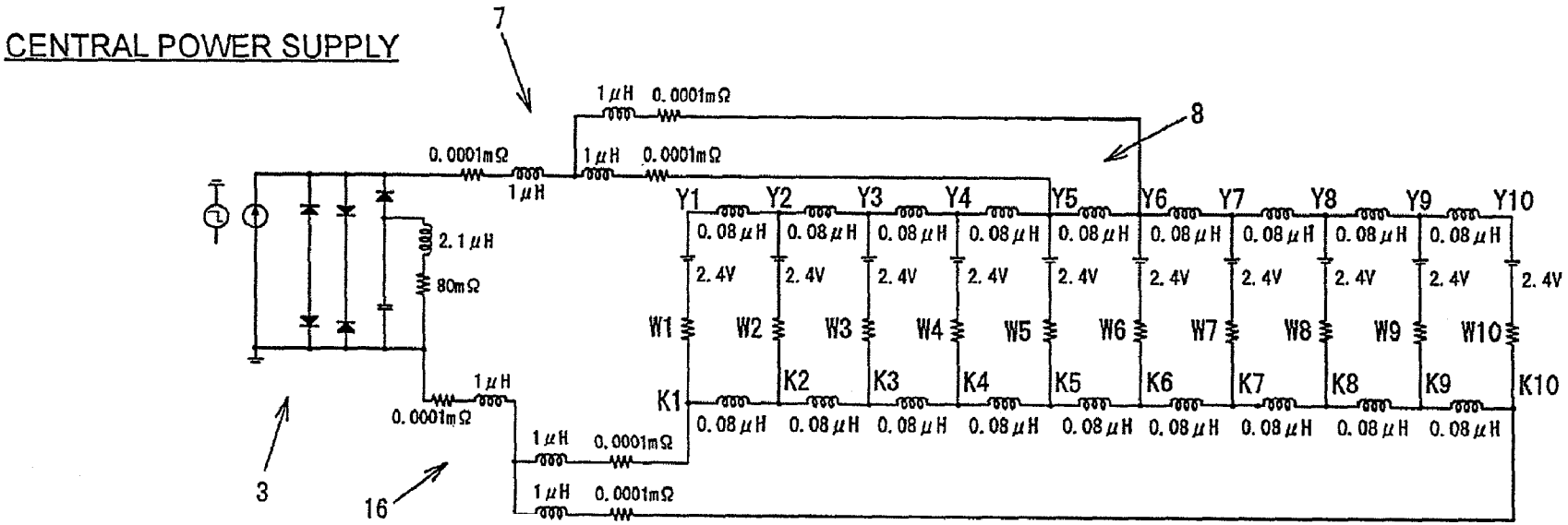
FIG. 2 is a circuit diagram which shows a simulation model of the chromium plating apparatus of FIGS. 1A to 1C.
Figure 3:
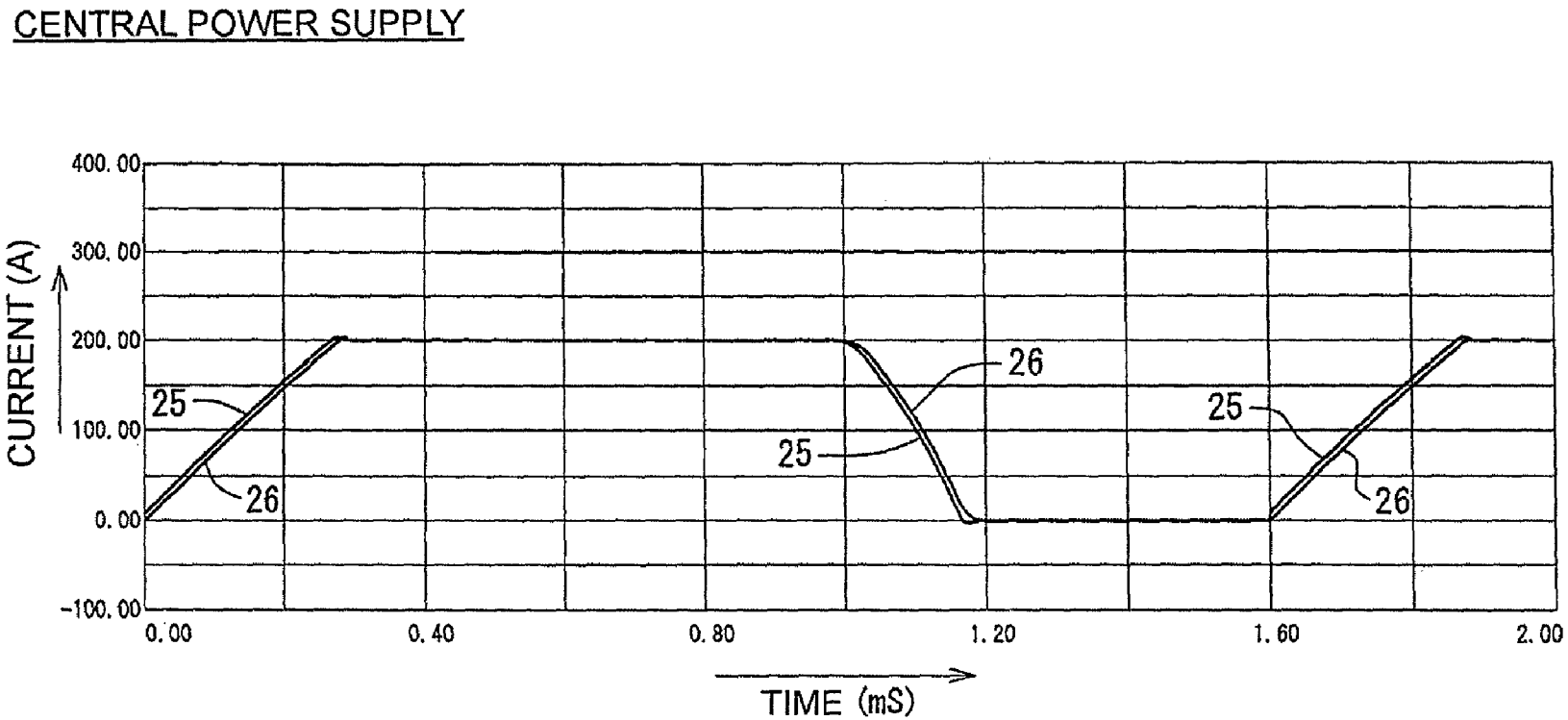
FIG. 3 is a waveform diagram which shows calculation results obtained in the simulation model of FIG. 2.

Because, as described above, each inductance was set at an equal value, as shown in FIG. 2, calculations were performed accordingly to find a pulse current flowing through the works W by use of a simulation model corresponding to an equivalent circuit of the chromium plating apparatus 1. In this case, the calculations were made by supposing that each inductance described above is 0.08 μH. The results shown in FIG. 3 were obtained from the calculations. That is, a pulse current flowing through a work W near the feeding point 8 has the waveform 25 and a pulse current flowing through a work W spaced from the feeding point 8 has the waveform 26. Thus, it could be ascertained that almost equal pulse currents are supplied to each work W without a great difference, although a slight deviation occurs at the leading edge and the trailing edge, and that plating treatment can be evenly performed, with the result that quality can be made uniform.

In this first embodiment, works W are immersed in a plating bath containing an organic sulfonic acid by use of the above-described plating apparatus 1 and plating treatment which uses a pulse current (this treatment is hereinafter called pulse plating treatment). For this reason, in this embodiment, the same plating bath as described in the Examined Japanese Patent Application Disclosure No. 63-32874 (U.S. Pat. No. 4,588,481), i.e., the plating bath having the chemical composition as shown in the table of FIG. 4 is used as the above-described plating bath containing an organic sulfonic acid and a current pattern as shown in FIG. 5 is adopted as conditions for the pulse plating treatment.

Figures 4, 5:
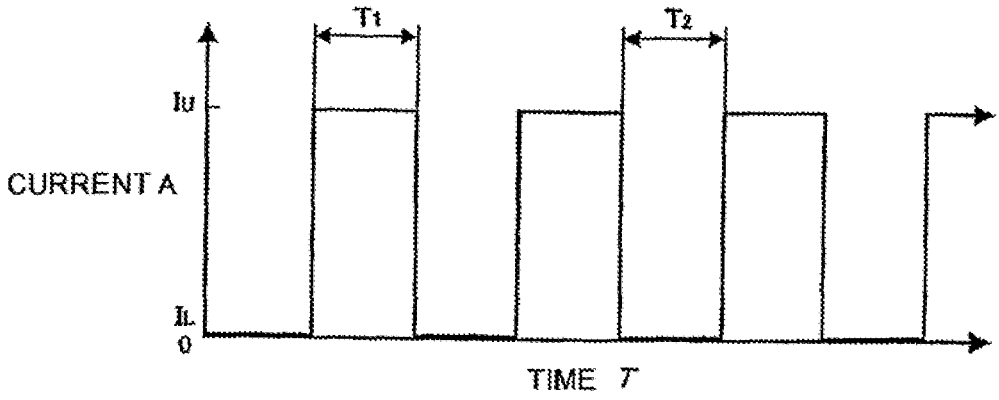
FIG. 4 is a diagram which shows in table form the chemical composition of a bath used in the chromium plating apparatus of FIGS. 1A to 1C.
FIG. 5 is a graph which shows an example of a waveform of a pulse current in a chromium plating method related to the chromium plating apparatus of FIGS. 1A to 1C.

In FIG. 5, the waveform of the pulse current is such that the current alternates between a maximum current density IU and a minimum current density IL and holds for a prescribed time T1, T2 at the maximum current density IU and the minimum current density IL.

In this case, the minimum current density IL is set at zero (off). It is needless to say, however, that the minimum current density IL may be set at an arbitrary value between the maximum current density IU and zero. The holding time T1 and T2 may be set at the same value or at different values.

Figure 6:
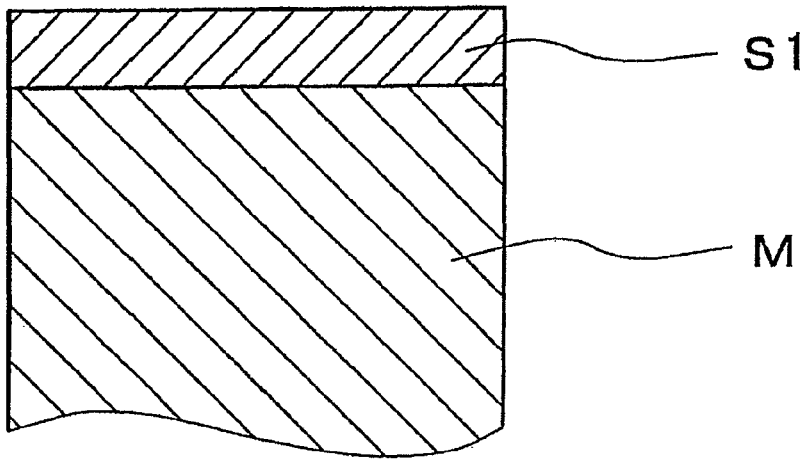
FIG. 6 is a schematic view which shows the condition of a surface layer portion of a chromium plated part obtained by a chromium plating method related to the chromium plating apparatus of FIGS. 1A to 1C.

In this first embodiment, pulse plating treatment is performed by first setting the above-described maximum current density IU and minimum current density value IL (in this case, IL=0) and the holding time T1 and T2, for which the current is held at these current densities, at appropriate values and as shown in FIG. 6, a chromium layer S1 having a desired compressive residual stress, which is an underlayer, is deposited on the surface of a steel base material (work W) M.

FIG. 6 shows the structure of a surface portion of a plated part obtained by the above-described apparatus and method, and the chromium layer S1 free from cracks is provided on the surface of the steel base material M. In this case, the chromium layer S1 is formed so as to have a compressive residual stress of not less than 100 MPa. Because in this embodiment the inductance between each of the works W1 to W10 is made equal irrespective of the works, the pulse waveform of each of the currents supplied to each of the works W1 to W10 is uniform; hence it is ensured that a compressive residual stress of the above-described level can be obtained in all of the works W1 to W10.

Because the chromium plated part thus obtained is provided with the chromium layer S1 free from cracks, media which cause corrosion do not reach a metal substrate of the steel base material M and desired corrosion resistance is ensured. In addition, because this chromium layer S1 has a prescribed compressive residual stress, new crack initiation does not occur even when the part is subjected to a thermal history and excellent corrosion resistance is maintained.

In the first embodiment, the cathode holding body 15 is, in both end portions thereof, connected to the pulse power source 3 as described above. Also, if the connection length of the cathode-side bus bar 16 with respect to both ends of the cathode holding body 15 differs, that is, if, for example, the length from a connection 17*a* to the cathode-side bus-bar main body 17 to the second orthogonal plate 21 (for the sake of convenience, hereinafter called the second-orthogonal-plate-side line length f2) is larger than the length from a connection 18*a* to the cathode-side bus-bar main body 17 to the first orthogonal plate 20 in the cathode-side bus-bar extension length 18 (for the sake of convenience, hereinafter called the first-orthogonal-plate-side line length f1), the inductances of the wiring differ at the right and left sides of each of the works W, with the result that different pulse currents flow to the works W. To cope with this problem, it is possible to construct a chromium plating apparatus of the present invention as shown in FIGS. 7A and 7B (the second embodiment).

Figure 7A:
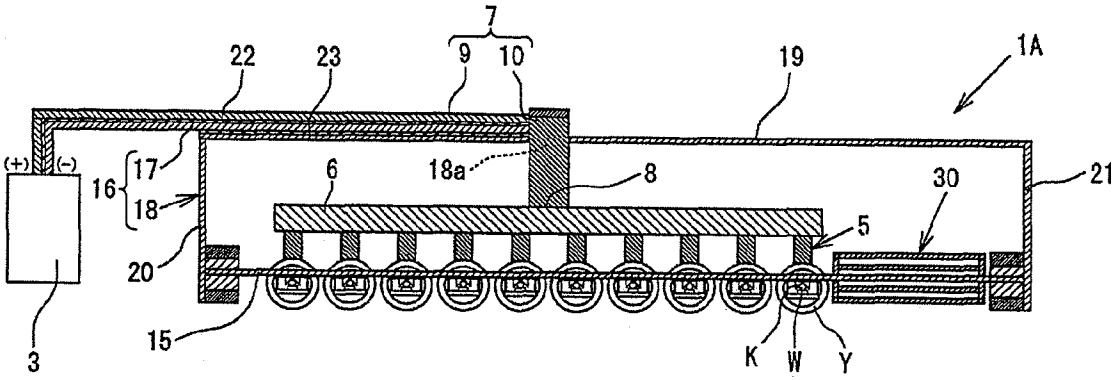
FIG. 7A is a plan sectional view which schematically shows a chromium plating apparatus in the second embodiment of the present invention.
Figure 7B:
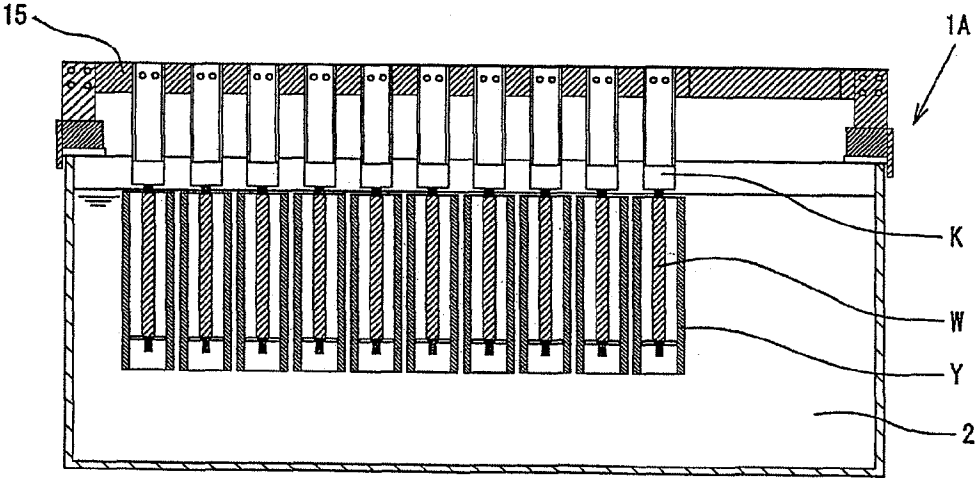
FIG. 7B is a front sectional view which schematically shows a chromium plating apparatus in the second embodiment of the present invention.

In a chromium plating apparatus 1A of the second embodiment, as shown in FIGS. 7A and 7B, a plurality of (five in this embodiment) auxiliary plates 30 are formed in parallel over a prescribed length in the portion of the second orthogonal plate 21 side in a cathode holding member 15. By providing the five auxiliary plates 30, the inductances of the wiring are made equal at the right and left sides of each work W.

In this second embodiment, pulse currents flowing through the works W are equal on the right and left sides and hence it is possible to ensure uniform plating treatment for each of the works W.

Incidentally, in the explanation of the second embodiment, a description was given of a case where five parallel auxiliary plates 30. However, the chromium plating apparatus may be constructed by using one auxiliary plate 30 in place of the five auxiliary plates 30 and increasing the sectional area of the auxiliary plate 30.

Also, in the explanation of the second embodiment, a description was given of a case where the inductance of the wiring to each work W differs on the right and left sides because of a difference between the first-orthogonal-plate-side line length f1 and the second-orthogonal-plate-side line length f2. However, also in a case where the inductances differ on the right and left sides due to other factors, it is possible to provide auxiliary plates in the portion on the second orthogonal plate 21 side or the portion on the first orthogonal plate 20 side in the cathode holding body 15, whereby the inductances can be made equal on the right and left sides by adjusting the sectional area, number or length of the auxiliary plates.

In the explanation of the first embodiment, a description was given of a case where the inductances of wiring between adjacent anodes Y and the inductances of wiring between adjacent cathodes K are sufficiently small, and even pulse currents are caused to flow through each work W by performing setting so that the above-described inductance becomes equal. However, in a case where the above-described inductance is sufficiently large, variations may sometimes occur in pulse currents flowing through each work W even when setting is performed as described above.

Figure 8A:
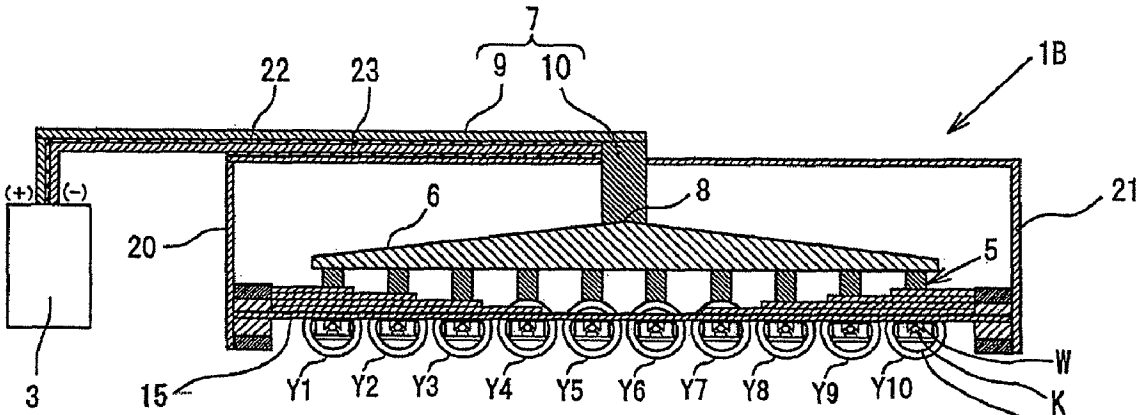
FIG. 8A is a plan sectional view which schematically shows a chromium plating apparatus in the third embodiment of the present invention.
Figure 8B:
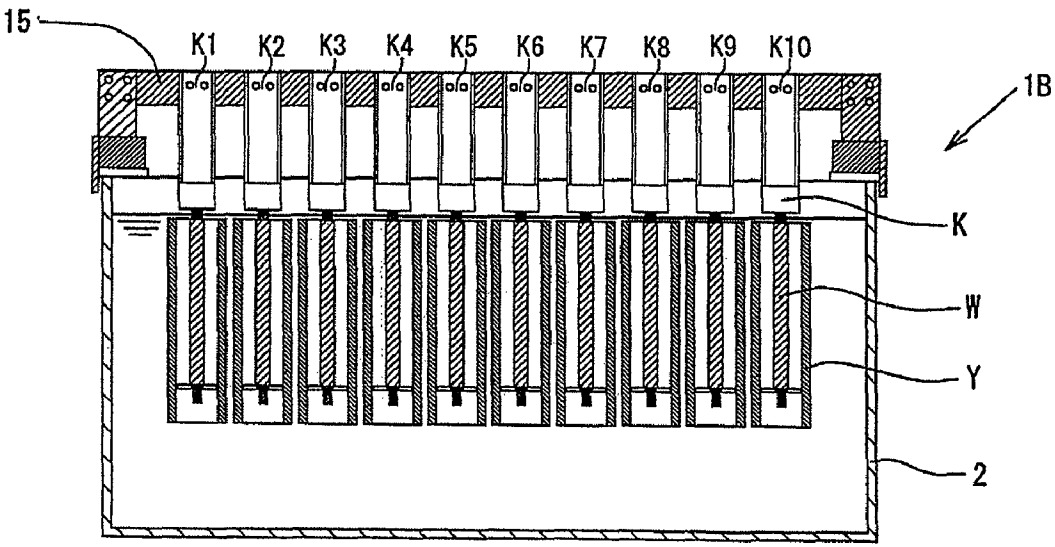
FIG. 8B is a front sectional view which schematically shows a chromium plating apparatus in the third embodiment of the present invention.

To cope with this problem, it is possible to construct a chromium plating apparatus of the present invention as shown in FIGS. 8A and 8B (the third embodiment).

Figure 9:
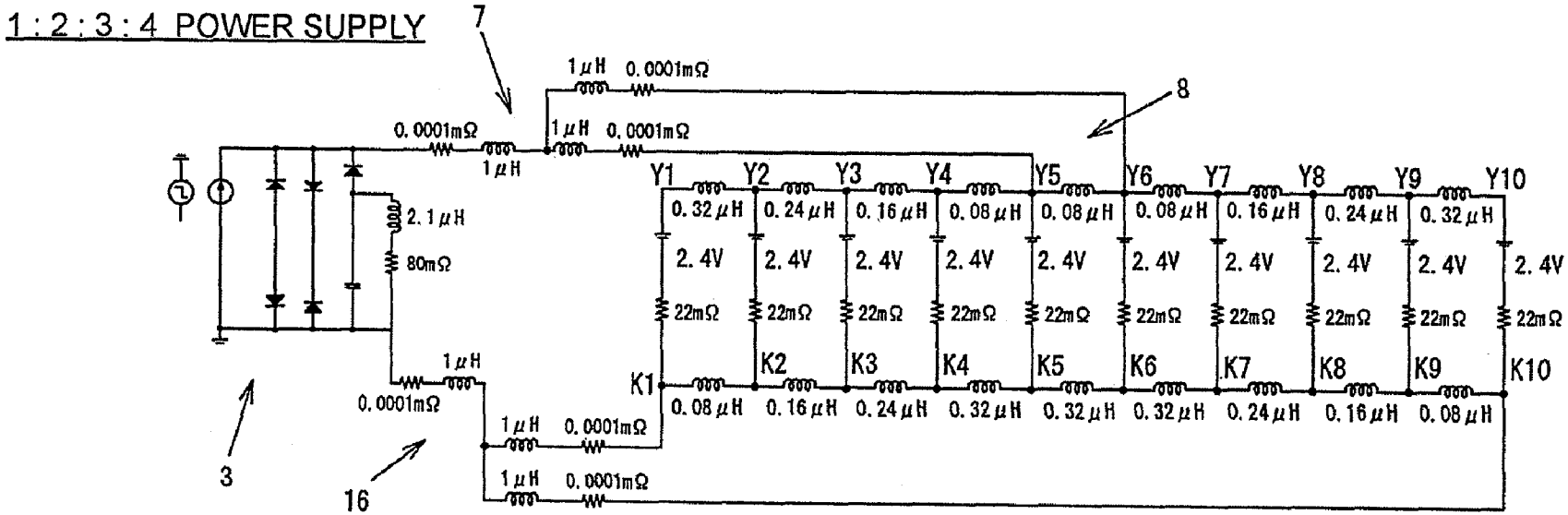
FIG. 9 is a circuit diagram which shows a simulation model of the chromium plating apparatus of FIGS. 8A to 8C.

In a chromium plating apparatus 1B of the third embodiment, as shown in FIGS. 8A and 8B and FIG. 9, for an anode holding body 6, setting is performed so that the inductance of wiring between the electrodes increases by changing the sectional area (thickness) with increasing distance from the fifth and sixth anodes Y5, Y6 [corresponding to a feeding point 8 (a connection to a pulse power source 3)] (that is, toward the end portion sides). Also, for a cathode holding body 15, setting is performed so that the inductance of wiring between the electrodes increases by changing the sectional area (thickness) with increasing distance from the first and tenth cathodes K1 and K10 [corresponding to a connection to the pulse power source 3] (that is, toward the center part).

That is, the inductance of wiring between the fourth and fifth anodes Y4 and Y5 is 0.08 μH, the inductance of wiring between the third and fourth anodes Y3 and Y4 is 0.16 μH, the inductance of wiring between the second and third anodes Y2 and Y3 is 0.24 μH, the inductance of wiring between the first and second anodes Y1 and Y2 is 0.32 μH, the inductance of wiring between the sixth and seventh anodes Y6 and Y7 is 0.08 μH, the inductance of wiring between the seventh and eighth anodes Y7 and Y8 is 0.16 μH, the inductance of wiring between the eighth and ninth anodes Y8 and Y9 is 0.24 μH, and the inductance of wiring between the ninth and tenth anodes Y9 and Y10 is 0.32 μH.

Also, the inductance of wiring between the first and second cathodes K1 and K2 is 0.08 μH, the inductance of wiring between the second and third cathodes K2 and K3 is 0.16 μH, the inductance of wiring between the third and fourth cathodes K3 and K4 is 0.24 μH, the inductance of wiring between the fourth and fifth cathodes K4 and K5 is 0.32 μH, the inductance of wiring between the ninth and tenth cathodes K9 and K10 is 0.08 μH, the inductance of wiring between the eighth and ninth cathodes K8 and K9 is 0.16 μH, the inductance of wiring between the seventh and eighth cathodes K7 and K8 is 0.24 μH, and the inductance of wiring between the sixth and seventh cathodes K6 and K7 is 0.32 μH.

Figure 10:
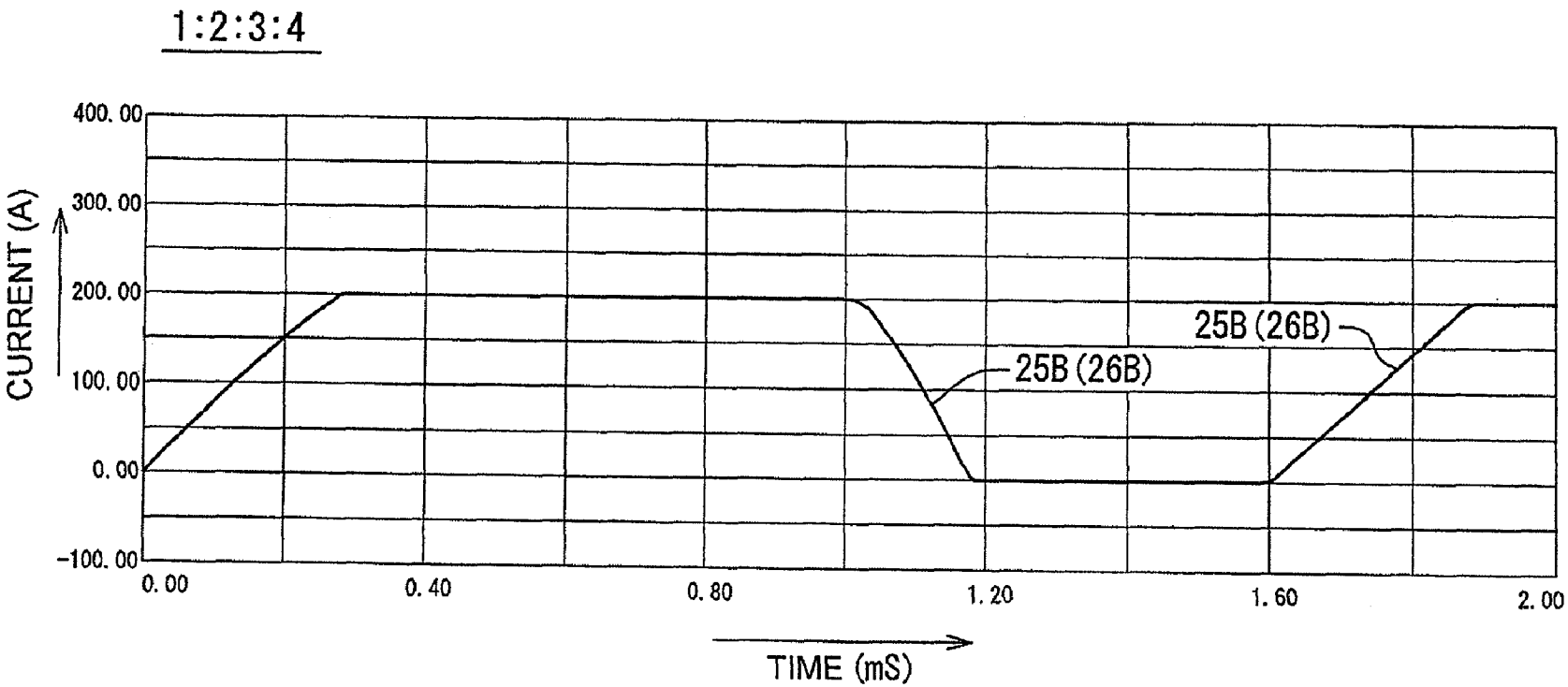
FIG. 10 is a waveform diagram which shows calculation results obtained in the simulation model of FIG. 9.

Because, as described above, the inductances of wiring between the electrodes were set at the above-described values, as shown in FIG. 9, calculations were performed accordingly to find a pulse current flowing through a work W by use of a simulation model corresponding to an equivalent circuit of the chromium plating apparatus 1B. The results shown in FIG. 10 were obtained from the calculations. That is, a pulse current flowing through a work W near the feeding point 8 and a pulse current flowing through a work W spaced from the feeding point 8 overlap each other, including the leading and trailing edges, as shown in the waveforms 25B, 26B. Thus, it could be ascertained that almost equal pulse currents are supplied to each work and that plating treatment can be evenly performed, with the result that quality can be made uniform.

In the explanation of the third embodiment, the inductance between the fourth and fifth anodes Y4 and Y5 (the sixth and seventh anodes Y6 and Y7) is 0.08 μH and setting is performed so that the inductance becomes twice (0.16 μH), three times (0.24 μH) and four times (0.32 μH) with increasing distance from the fourth and fifth anodes Y4 and Y5 (the sixth and seventh anodes Y6 and Y7). Also, the inductance of wiring between the first and second cathodes K1 and K2 is 0.08 μH and setting is performed so that the inductance becomes twice (0.16 μH), three times (0.24 μH) and four times (0.32 μH) with increasing distance from the first and second cathodes K1 and K2. That is, when the inductance of the connection side to the pulse power source 3 is denoted by L, setting is performed so that the inductance becomes 2L, 3L, 4L with increasing distance from this connection side (that is, setting is performed so that the ratio of the inductance becomes 1:2:3:4 with increasing distance from the connection side to the pulse power source 3).

In the explanation of the third embodiment, a description was given of a case where the number of works W is ten. When the number of works W is twelve, setting is performed so that the relationship of the ratio of the inductance on the connection side to the pulse power source 3 to the induction of the portion which is sequentially spaced in an increasing manner from the above-described connection to the pulse power source 3 becomes 1:2:3:4:5. Also, when the number of works W is fourteen, setting is performed so that the above-described relation becomes 1:2:3:4:5:6.

In each of the explanation of the embodiments, a description was given of a case where the section from the pulse power source 3 to the anode holding body 6 and the section from the pulse power source 3 to the cathode holding body 15 are formed from a bus bar. However, a cable etc. may be used in place of the bus bar.

In each of the explanation of the embodiments, a description was given of a case where the positive pole terminal 3*a* side of the pulse power source 3 is connected to the middle part (feeding point 8) of the anode holding body 6 and the negative pole terminal 3*b* side of the pulse power source 3 is connected to both end portions of the cathode holding body 15. However, in place of this construction, a chromium plating apparatus of the present invention may be constructed in such a manner that the positive pole terminal 3*a* side of the pulse power source 3 is connected to both end portions of the anode holding body 6, and the negative pole terminal 3*b* side of the pulse power source 3 is connected to the middle part of the cathode holding body 15.

Also, a chromium plating apparatus of the present invention may be constructed in such a manner that by adjusting the relationship of the ratio of inductance as in the explanation of the third embodiment, that is, by adjusting this relationship so that the same pulse current can be supplied as in the third embodiment to each work W, the positive terminal 3*a* side of the pulse power source 3 is connected to both end portions of the anode holding body 6, and the negative pole terminal 3*b* side of the pulse power source 3 is connected to both end portions of the cathode holding body 15.

In the chromium plating apparatus of the explanation of the first to third embodiments, the anodes are cylindrical and works are inserted into the cylindrical anodes, with the result that the works can be subjected to plating treatment with good accuracy.

Next, the fourth to sixth embodiments of the present invention will be described on the basis of FIGS. 11 to 16 and with reference to FIGS. 1A to 1C and FIG. 2. Compared to the construction of the first to third embodiments wherein anodes are cylindrical and works are inserted in the cylindrical anodes, the chromium plating apparatus in the fourth to sixth embodiments differ greatly in that the anodes are in plate form and that works are disposed between pairs of the plate-like anodes.

First, a chromium plating apparatus in the fourth embodiment of the present invention will be described on the basis of FIGS. 11 and 12 and with reference to FIGS. 1A to 1C, FIG. 2 and FIG. 3.

Figure 11:
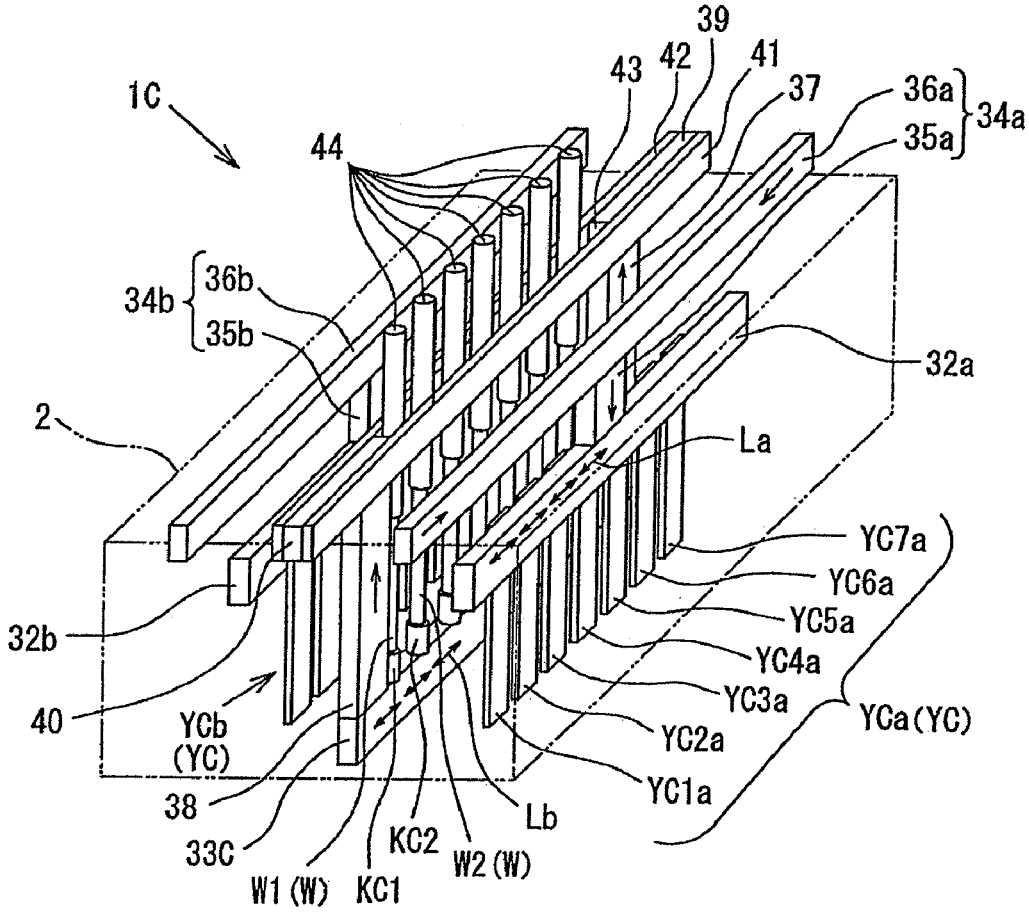
FIG. 11 is a perspective view which schematically shows a chromium plating apparatus in the fourth embodiment of the present invention.
Figure 12:
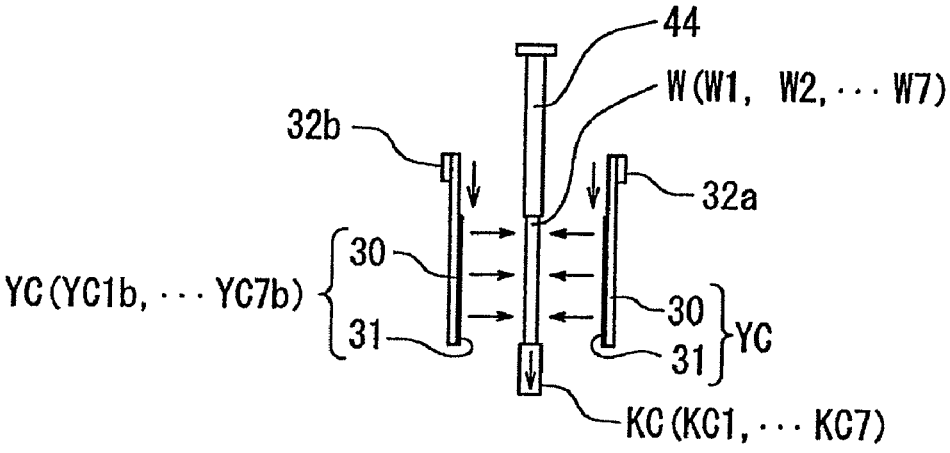
FIG. 12 is a front view which schematically shows the flow of currents of the chromium plating apparatus of FIG. 11.

In FIGS. 11 and 12, a chromium plating apparatus 1C has a batch treatment tank 2 fabricated from an electrically insulating material, and the tank 2 houses a plating bath containing an organic sulfonic acid. In this tank 2, seven elongated works W (W1 to W7) are immersed in a row in the chromium plating bath at a prescribed spacing, by being vertically set, and a chromium layer having a desired compressive residual stress is deposited on the surfaces of the works W by use of a pulse current from a pulse power source 3 (refer to FIGS. 1A to 1C and FIG. 2). In the batch treatment tank 2, seven pairs of plate-like anodes YC (14 anodes in all) are arranged for seven elongated works W (W1 to W7) in the form of a piston rod, for example. A bottomed cylindrical cathode KC is connected to each of the seven elongated works W. The anodes YC are constituted by a plate-like electrode main body 30 made of titanium and an oxidation inhibitor 31 of lead which is applied to one surface side of the electrode main body 30 and suppresses the oxidation of the electrode main body 30.

Hereinafter, the seven anodes YC on one side (the right-hand side of FIG. 11) for the works W (W1 to W7) are appropriately called the first, second, . . . seventh anodes YC1*a*, YC2*a*, . . . YC7*a* in order from the left of FIG. 11 and they are generically called the first anode group on one side YCa. Similarly, the seven anodes YC on the other side (the left-hand side of FIG. 11) for the works W (W1 to W7) are appropriately called the first, second, . . . seventh anodes YC1*b*, YC2*b*, . . . YC7*b* in order from the left of FIG. 11 and they are generically called the second anode group on the other side YCb. Also, the seven cathodes KC are appropriately called the first, second, . . . seventh cathodes KC1, KC2, . . . KC7 in order from the left of FIG. 11.

The chromium plating apparatus 1C further has a plate-like first anode holding part on one side 32*a* which is connected sequentially to the first anode electrode group on one side YCa and is connected to a positive pole 3*a* of a pulse power source 3, a plate-like second anode holding part on the other side 32*b* which connected sequentially to the second anode electrode group on the other side YCb and is connected to the positive pole 3*a* of the pulse power source 3, and a plate-like cathode holding body 33C which connected sequentially to seven cathodes KC (KC1, KC2, . . . KC7) and is connected to a negative pole 3*b* of the pulse power source 3.

The first anode holding part on one side 32*a* is provided above the first anode electrode group on one side YCa. The second anode holding part on the other side 32*b* is provided above the second anode electrode group on the other side YCb. The cathodes KC are electrically connected to the works W (W1 to W7) and at the same time, the cathodes KC house bottom end portions (bottom end portions in FIG. 11) of the works W (W1 to W7) in a liquid-tight manner against the outside (the chromium plating bath) and support the works (W1 to W7) (that is, the cathodes KC are provided under the works W).

To the substantially middle part of the first anode holding part on one side 32*a* is connected a vertical plate portion 35*a* of a T-shaped wiring plate 34*a* which causes a current from the pulse power source 3 to flow (hereinafter called a first T-shaped wiring plate on one side). The first T-shaped wiring plate on one side 34*a* is connected, at both end portions of a lateral plate 36*a* thereof, to the positive pole 3*a* of the pulse power source 3 and supplies a current from the pulse power source 3 to the first anode group on one side YCa via the substantially middle part of the first anode holding part on one side 32*a*.

To the substantially middle part of the second anode holding part on the other side 32*b* is connected a vertical plate portion 35*b* of a T-shaped wiring plate 34*b* which causes a current from the pulse power source 3 to flow (hereinafter called a second T-shaped wiring plate on the other side). The second T-shaped wiring plate on the other side 34*b* is connected, at both end portions of a lateral plate 36*b* thereof, to the positive pole 3*a* of the pulse power source 3 and supplies a current from the pulse power source 3 to the second anode group on the other side YCb via the substantially middle part of the second anode holding part on the other side 32*b*.

The cathodes KC (KC1, KC2, . . . KC7) are placed on the cathode holding body 33C in order from left to right of FIG. 11, and the cathode holding body 33C is electrically connected to the cathodes KC. A first plate material 37 and a second plate material 38 are vertically provided on the right-hand and left-hand end portions of the cathode holding body 33C in FIG. 11. A first flange 39 and a second flange 40 are brought into continuous contact with the first and second plate materials 37, 38 orthogonally thereto, respectively, and the first and second flanges 39, 49 are connected to the negative pole 3*b* of the pulse power source.

To the side of one surface (the side of the first anode holding part on one side 32*a*) in the first and second flanges 39, 40 and to the side of the other surface (the side of the second anode holding part on the other side 32*b*) in the first and second flanges 39, 40, there are respectively attached a plate material on one side 41 and a plate material on the other side 42 in such a manner as to bridge the first and second flanges 39, 40. A cylindrical body 44 which becomes a weight for the works W (W1 to W7) in a space 43 which is formed between the first and second flanges 39, 40 in the plate material on one side 41 and the plate material on the other side 42. The cylindrical body 44 applies a prescribed load to each of the works W (W1 to W7), with the top end portion (not shown) of the works (W1 to W7) inserted in the cylindrical body 44 to ensure that the holding of the works W (W1 to W7) and electrical connection to the cathodes KC can be positively performed.

Each of the inductances between the first, second, . . . seventh anodes YC1*a*, YC2*a*, . . . YC7*a* in the first anode holding part on one side 32*a* (each of the inductances between the adjacent anodes in the first anode holding part on one side 32*a* in the sixth and thirteenth aspects) and each of the inductances between the first, second, . . . seventh anodes YC1*b*, YC2*b*, . . . YC7*b* in the second anode holding part on the other side 32*b* (each of the inductances between the adjacent anodes in the second anode holding part on one side 32*b* in the sixth and thirteenth aspects) are set at the first standard value La.

Each of the inductances between the adjacent cathodes KC (the first, second, . . . seventh cathodes KC1, KC2, . . . KC7 in the sixth and thirteenth aspects) in the cathode holding body 33C (each of the inductance between the adjacent cathodes in the cathode holding body 33C), the inductance between one end portion of the cathode holding body 33C and the first cathode KC1, and the inductance between the other end of the cathode holding body 33C and the seventh cathode KC7 (the inductance between the end portion in the sixth and thirteenth aspects and the cathode adjacent to the end portion) are set at the second standard value Lb. In this embodiment, Lb=2La.

In the chromium plating apparatus 1C thus constructed, as shown in FIGS. 11 and 12, a current from the positive pole 3*a* of the pulse power source 3 is supplied from the vertical plate 35*a* of the first T-shaped wiring plate on one side 34*a* to the first anode group on the other side YCa via the substantially middle part of the first anode holding part on one side 32*a*, and at the same time, from the vertical plate portion 35*b* of the second T-shaped wiring plate on the other side 34*b* to the second anode group on the other side YCb via the substantially middle part of the second anode holding part on the other side 32*b*. Also this current flows through the plating bath to the works W (W1 to W7), then to the cathodes KC (the first, second, . . . seventh cathodes KC1, KC2, . . . KC7), to the cathode holding body 33C, to the first and second plate materials 37, 38, to the first and second flanges 39, 40, and then returns to the pulse power source 3 (the negative pole 3*b*). A chromium layer having a prescribed compressive residual stress is deposited on the surfaces of the works W according to this flow of the current.

Because each inductance was set as described above, calculations were performed accordingly to find a pulse current flowing through the works W by use of a simulation model (refer to FIG. 2) corresponding to an equivalent circuit of the chromium plating apparatus 1C. It could be ascertained from the calculations that the pulse current flowing through the works W3 to W5 near the substantially middle part of the first anode holding part on one side 32*a* and the pulse current flowing through the works W1, W2, W6 and W7 spaced from the substantially middle part of the first anode holding part on one side 32*a* have waveforms which have no great difference, although there is a slight deviation at the leading edge and the trailing edge almost like the waveform shown in FIG. 3, with the result that substantially equal pulse currents are supplied to each work W, that plating treatment can be evenly performed, and that quality can be made uniform.

Furthermore, because the chromium plating apparatus 1C has the seven pairs of anodes (the first to seventh anodes on one side YC1*a* to YC7*a* and the first to seventh anodes on the other side YC1*b* to YC7*b*) disposed in face-to-face relation with the seven works W1 to W7, which are connected to the first to seventh cathodes KC1 to KC7, disposed therebetween, it is possible to set equipment accuracy moderately compared to the case where the anodes are cylindrical, and hence it is possible to simplify the equipment and reduce the cost of new equipment. Incidentally, this applies also to chromium plating apparatus 1D and 1E, which will be described later.

Next, a chromium plating apparatus in the fifth embodiment of the present invention will be described on the basis of FIGS. 13 and 14 and with reference to FIGS. 1A to 1C, FIGS. 2 and 3, FIGS. 11 and 12.

Figure 13:
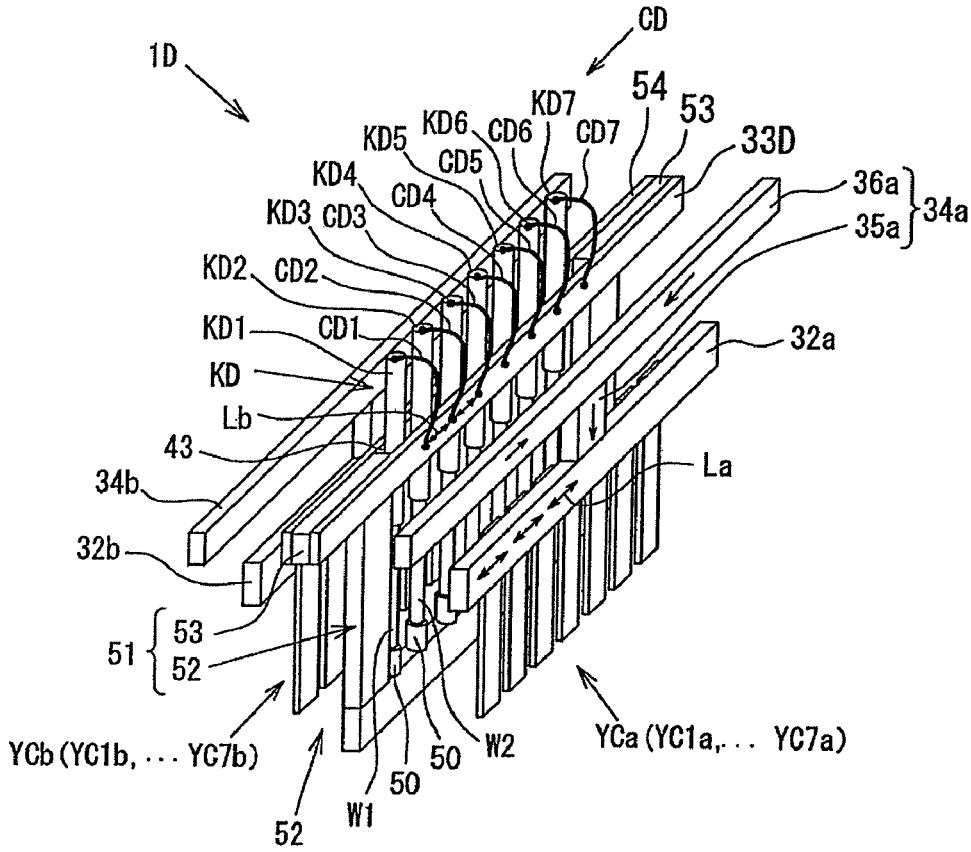
FIG. 13 is a perspective view which schematically shows a chromium plating apparatus in the fifth embodiment of the present invention.
Figure 14:
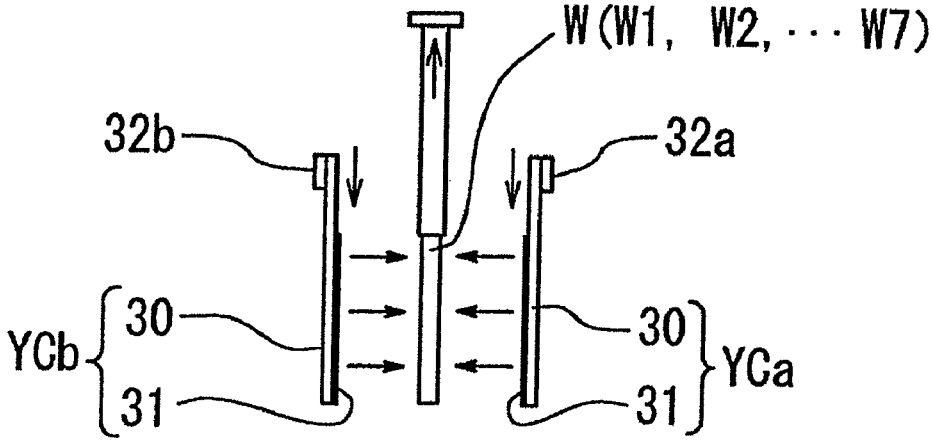
FIG. 14 is a front view which schematically shows the flow of currents of the chromium plating apparatus of FIG. 13.

In FIGS. 13 and 14, the chromium plating apparatus 1D differs from the chromium plating apparatus 1C [the fourth embodiment (FIGS. 11 and 12)] mainly in that the cathodes KD (the first, second, . . . seventh cathodes KD1, KD2, . . . KD7) are provided above the works W (W1 to W7) (the plurality of negative poles are provided above the above-described works W).

As shown in FIGS. 13 and 14, the bottom end portion of each of the seven works (W1 to W7) of the chromium plating apparatus 1D is inserted into a bottomed cylindrical body 50 and each of the cylindrical cathodes KD (the first, second, . . . seventh cathodes KD1, KD2, . . . KD7) is inserted into the top end portion of each of the seven works (W1 to W7). The cathodes KD perform electrical connection to the works W (W1 to W7), and the cathodes KD have a prescribed load and push the works W (W1 to W7) toward the bottomed cylindrical body 50 side.

The cathodes KD (the first, second, . . . seventh cathodes KD1, KD2, . . . KD7) are connected to a plate-like cathode holding body 33D via cables CD (cables CD1 to CD7), which are respectively connected so as to correspond to each of the cathodes KD. The cathode holding body 33D is connected, at both end portions thereof, to the negative pole 3*b* of the pulse power source 3 (refer to FIG. 12). The cathode holding body 33D is held on the leading end side of a Π-shaped member 51. The Π-shaped member 51 is constituted by a Π-shaped main body portion 52, which has a roughly Π-shaped configuration and places the bottomed cylindrical body 50 in the middle portion of the width, and flanges 53, which are each provided in a protruding condition outward on the leading end side of the Π-shaped main body portion 52. The cathode holding body 33D is provided on the side of a first anode group on one side YCa of the flanges 53 (the right-hand side of FIG. 13) in such a manner as to bridge the two flanges 53. On the side of a second anode group on the other side YCb of the flanges 53 (the left-hand side of FIG. 13), a plate material 54 is provided so as to form a pair with the cathode holding body 33D.

The cathodes KD are inserted into a space 43, which is formed between the two flanges 53 in the plate material 45 and the cathode holding body 33D, and one end portion of each of the above-described cables CD (cables CD1 to CD7) is connected to the leading end portion of each of the cathodes KD protruding from the above-described space 43. In this case, the other end portion of each of the cables CD (cables CD1 to CD7) is connected to the cathode holding body 33D in the order, the cables CD1, CD2, CD3, . . . CD7 from the left of FIG. 13.

The inductance in the first anode holding part on one side 32*a* and the second anode holding part on one side 32*b* is set in the same manner as in the fourth embodiment.

Each of the inductances between the adjacent cables CD1, CD2, CD3, . . . CD7 in the cathode holding body 33D [consequently, cathodes KD (the first, second, . . . seventh cathodes KD1, KD2, . . . KD7)] (, each of the inductances between the adjacent cathodes KD in the cathode holding body 33D), the inductance between one end portion of the cathode holding body 33D and the cable CD1 [the first cathode electrode KD1], and the inductance between the other end portion of the cathode holding body 33D and the cable CD7 [the seventh cathode electrode KD7] (the inductance between the end portion and the cathode adjacent to the end portion in the sixth and thirteenth aspects) are set at the second standard value Lb. In this embodiment, Lb=2La.

In the chromium plating apparatus 1D thus constructed, as shown in FIGS. 13 and 14, a current from the positive pole 3*a* of the pulse power source 3 is supplied from the vertical plate portion 35*a* of the first T-shaped wiring plate on one side 34*a* to the first anode group on one side YCa via the substantially middle part of the first anode holding part on one side 32*a* and at the same time, from the vertical plate portion 35*b* of the second T-shaped wiring plate on the other side 34*b* to the second anode group on the other side YCb via the substantially middle part of the second anode holding part on the other side 32*b*. Also this current flows through the plating bath to the works W (W1 to W7), then to the cathodes KD (the first, second, . . . seventh cathodes KD1, KD2, . . . KD7), to the cables CD1, CD2, CD3, . . . CD7, to the cathode holding body 33D, and then returns to the pulse power source 3 (the negative pole 3*b*). A chromium layer having a prescribed compressive residual stress is deposited on the surfaces of the works W according to this flow of the current.

Because each inductance was set as described above, calculations were performed to find a pulse current flowing through the works W by use of a simulation model (refer to FIG. 2) corresponding to an equivalent circuit of the chromium plating apparatus 1D. It could be ascertained from the calculations that the pulse current flowing through the works W3 to W5 near the substantially middle part of the first anode holding part on one side 32*a* (the second anode holding part on the other side 32*b*) and the pulse current flowing through the works W1, W2, W6 and W7 spaced from the substantially middle part of the first anode holding part on one side 32*a* (the second anode holding part on the other side 32*b*) have waveforms which have no great difference, although there is a slight deviation at the leading edge and the trailing edge almost like the waveform shown in FIG. 3, with the result that a substantially equal pulse current is supplied to each work W, that plating treatment can be evenly performed, and that quality can be made uniform.

Next, a chromium plating apparatus in the sixth embodiment of the present invention will be described on the basis of FIGS. 15 and 16 and with reference to FIGS. 1A to 1C, FIGS. 2 and 3, FIGS. 11 and 12.

Figure 15:
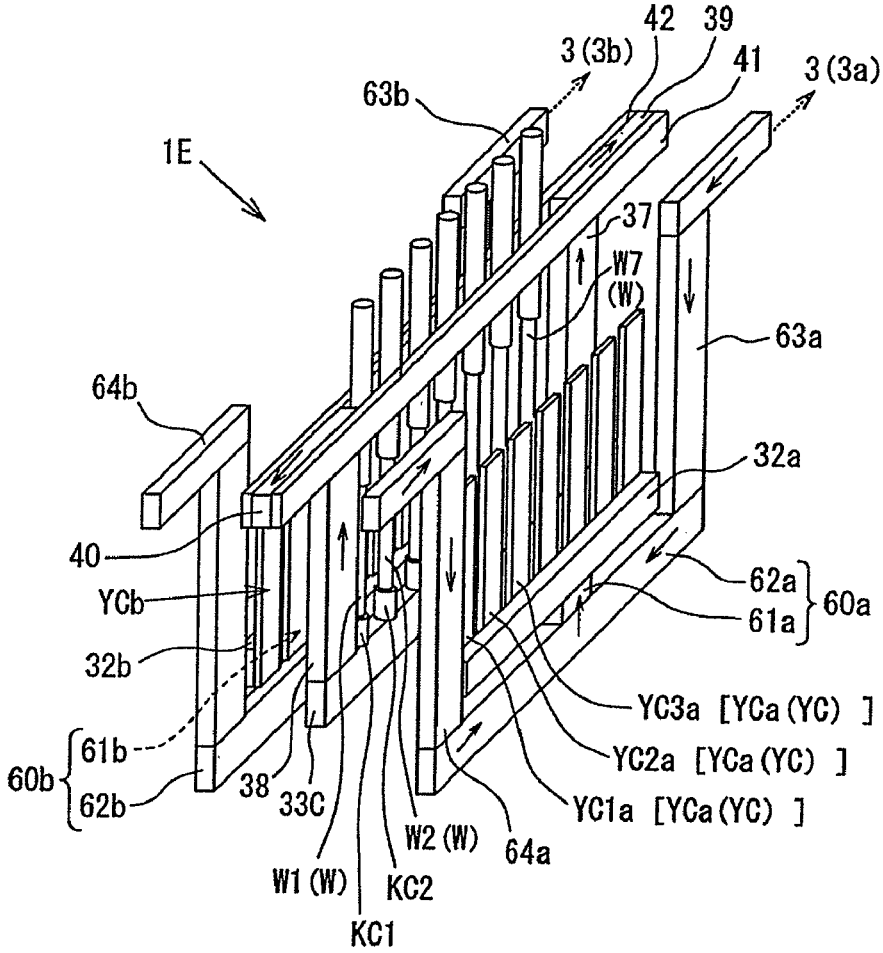
FIG. 15 is a perspective view which schematically shows a chromium plating apparatus in the sixth embodiment of the present invention.
Figure 16:
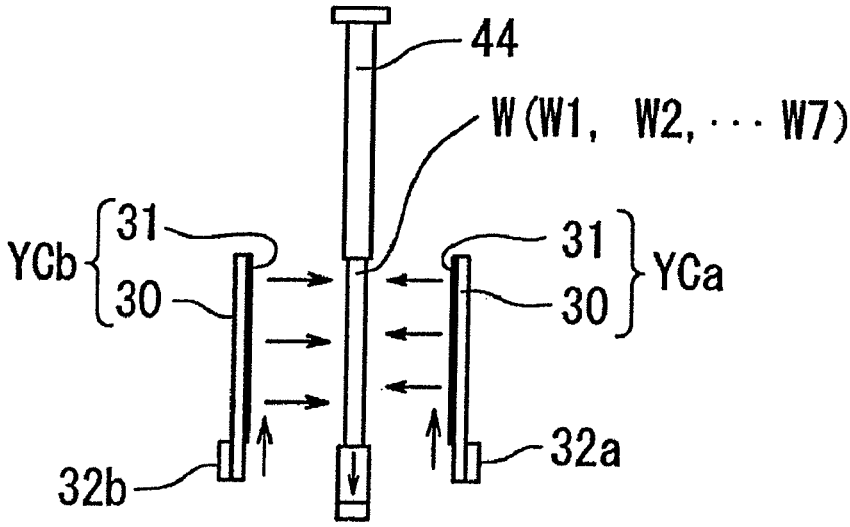
FIG. 16 is a front view which schematically shows the flow of currents of the chromium plating apparatus of FIG. 15.

In FIGS. 15 and 16, the chromium plating apparatus 1E differs from the chromium plating apparatus 1C [the fourth embodiment (FIGS. 11 and 12)] mainly in that the first anode holding part on one side 32*a* and the second anode holding part on the other side 32*b* are respectively provided below the first anode electrode group on one side YCa and the second anode electrode group on the other group YCb. The inductance in the first anode holding part on one side 32*a*, the second anode holding part on the other side 32*b* and the cathode holding body 33C is set in the same manner as in the fourth embodiment.

To the substantially middle part of the first anode holding part on one side 32*a* is connected a vertical plate portion 61*a* of an inverted T-shaped wiring plate 60*a* which causes a current from the pulse power source 3 to flow (hereinafter called a first inverted T-shaped wiring plate on one side). The first inverted T-shaped wiring plate on one side 60*a* is connected, in both end portions of a lateral plate 62*a* thereof, to the positive pole 3*a* of the pulse power source 3 via L-shaped members (hereinafter called a right L-shaped member on one side and a left L-shaped member on one side) 63*a*, 64*a* and supplies a current from the pulse power source 3 to the first anode group on one side YCa via the substantially middle part of the first anode holding part on one side 32*a*.

To the substantially middle part of the second anode holding part on the other side 32*b* is connected a vertical plate portion 61*b* of an inverted T-shaped wiring plate 60*b* which causes a current from the pulse power source 3 to flow (hereinafter called a second inverted T-shaped wiring plate on the other side). The second inverted T-shaped wiring plate on the other side 60*b* is connected, in both end portions of a lateral plate 62*b* thereof, to the positive pole 3*a* of the pulse power source 3 via L-shaped members (hereinafter called a right L-shaped member on the other side and a left L-shaped member on the other side) 63*b*, 64*b* and supplies a current from the pulse power source 3 to the second anode group on the other side YCb via the substantially middle part of the second anode holding part on the other side 32*b*.

In the chromium plating apparatus 1E thus constructed, as shown in FIGS. 15 and 16, a current from the positive pole 3*a* of the pulse power source 3 is supplied from the right and left L-shaped members on one side 63*a*, 64*a*, to the vertical plate portion 61*a* of the first inverted T-shaped wiring plate on one side 60*a*, to the first anode group on one side YCa via the substantially middle part of the first anode holding part on one side 32*a* and at the same time, from the right and left L-shaped members on the other side 63*b*, 64*b*, to the vertical plate portion 61*b* of the second inverted T-shaped wiring plate on the other side 60*b* to the second anode group on the other side YCb via the substantially middle part of the second anode holding part on the other side 32*b*. Also this current flows through the plating bath to the works W (W1 to W7), then to the cathodes KC (the first, second, . . . seventh cathodes KC1, KC2, . . . KC7), to the cathode holding body 33C, to the first and second plate materials 37, 38, to the first and second flanges 39, 40 and then returns to the pulse power source 3 (the negative pole 3*b*). A chromium layer having a prescribed compressive residual stress is deposited on the surfaces of the works W according to this flow of the current.

As described above, in the fourth embodiment (FIGS. 11 and 12), the cathodes KD are provided above the works (W1 to W7) and the first anode holding part on one side 32*a* and the second anode holding part on the other side 32*b* are respectively provided above the first anode group on one side YCa and the second anode group on the other side YCb.

In the fifth embodiment (FIGS. 13 and 14), the cathodes KD are provided below the works (W1 to W7) and the first anode holding part on one side 32*a* and the second anode holding part on the other side 32*b* are respectively provided above the first anode group on one side YCa and the second anode group on the other side YCb.

In the sixth embodiment (FIGS. 15 and 16), the cathodes KD are provided above the works (W1 to W7) and the first anode holding part on one side 32*a* and the second anode holding part on the other side 32*b* are respectively provided below the first anode group on one side YCa and the second anode group on the other side YCb.

Incidentally, the present invention is not limited to the above-described fourth to sixth embodiments. A chromium plating apparatus of the present invention may be constructed in such a manner that the cathodes KD are provided below the works W (W1 to W7) and the first anode holding part on one side 32*a* and the second anode holding part on the other side 32*b* are respectively provided below the first anode group on one side YCa and the second anode group on the other side YCb.

Because each inductance was set as described above, calculations were performed accordingly to find a pulse current flowing through the works W by use of a simulation model (refer to FIG. 2) corresponding to an equivalent circuit of the chromium plating apparatus 1E. It was ascertained from the calculations that the pulse current flowing through the works W3 to W5 near the substantially middle part of the first anode holding part on one side 32*a* and the pulse current flowing through the works W1, W2, W6 and W7 spaced from the substantially middle part of the first anode holding part on one side 32*a* have waveforms which have no great difference, although there is a slight deviation at the leading edge and the trailing edge almost like the waveform shown in FIG. 3, with the result that a substantially equal pulse current is supplied to each work W, that plating treatment can be evenly performed, and that quality can be made uniform.

Embodiment 1

By use of the chromium plating apparatus 1 shown in FIG. 1, ten steel bars made of JIS S45C (diameter 20 mm, length 400 mm, plating length 300 mm) (Steel Bars No. 1 to No. 10) as test materials were immersed in a chromium plating bath, the chemical composition of which is 260 g/L of chromic acid, 2.9 g/L of sulfuric acid (may be replaced with an equivalent amount of a sulfate) and 8 g/L of organic sulfonic acid. First, pulse plating treatment was performed under the conditions (hereinafter called the embodiment conditions): bath temperature 60° C., maximum current density IU=120 A/dm$^2$, minimum current density IL=0 A/dm$^2$ (the pattern of FIG. 5), holding time at the maximum current density IU (on time) T1=1.0 ms, holding time at the minimum current density IL (off time) T2=0.5 ms, and frequency 0.67 kHz, and a chromium layer S1 (FIG. 6) having a thickness of about 10 μm was formed on the surface of each of the test materials. Incidentally, Steel Bars No. 1 to No. 10 correspond to the Works W1 to W10 in FIG. 1.

Embodiment 2

By use of the same chromium plating apparatus 1A shown in FIG. 7, the same test materials as used in Embodiment 1 were immersed in the same plating bath, pulse plating treatment was performed under the above-described embodiment conditions, and a chromium layer S1 (FIG. 6) having a thickness of about 10 μm was formed on the surface of each of the test materials. Incidentally, Steel Bars No. 1 to No. 10 correspond to the Works W1 to W10 in FIG. 1.

Embodiment 3

By use of the same chromium plating apparatus 1B shown in FIG. 8, the same test materials as used in Embodiment 1 were immersed in the same plating bath, pulse plating treatment was performed under the above-described embodiment conditions, and a chromium layer S1 (FIG. 6) having a thickness of about 10 μm was formed on the surface of each of the test materials. Incidentally, Steel Bars No. 1 to No. 10 correspond to the Works W1 to W10 in FIG. 1.

Comparative Example 1

Figure 17A:
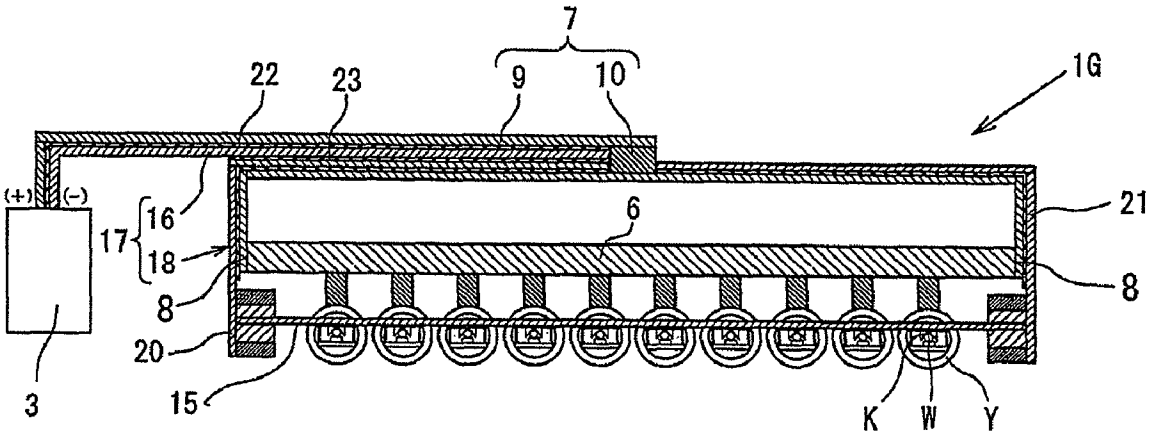
FIG. 17A is a plan sectional view which schematically shows a chromium plating apparatus used in Comparative Example 1.
Figure 17B:
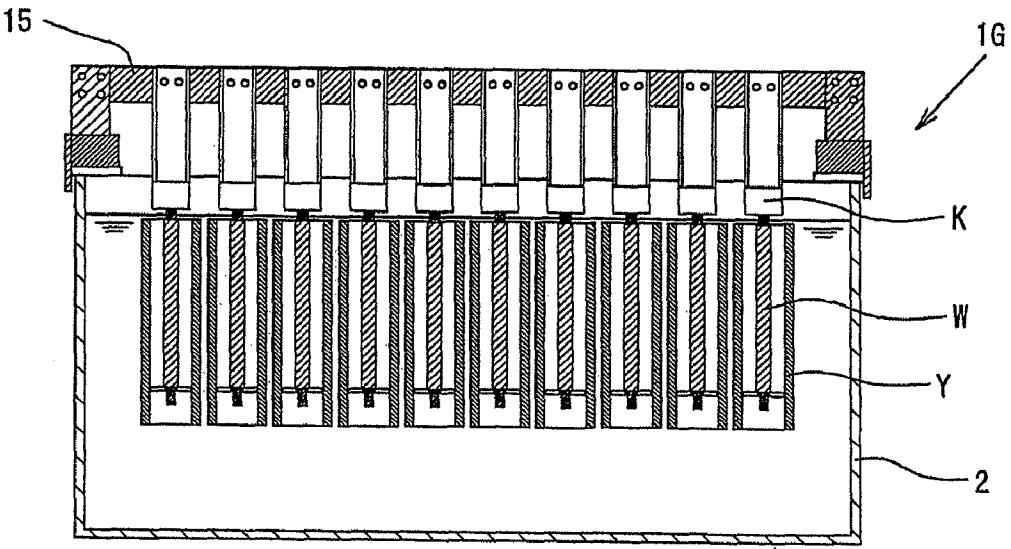
FIG. 17B is a front sectional view which schematically shows a chromium plating apparatus used in Comparative Example 1.

By use of the same chromium plating apparatus 1G shown in FIG. 17, the same test materials as used in Embodiment 1 were immersed in the same plating bath, pulse plating treatment was performed under the above-described embodiment conditions, and a chromium layer S1 (FIG. 6) having a thickness of about 10 μm was formed on the surface of each of the test materials. In the chromium plating apparatus 1G shown in FIG. 17, power is supplied from both ends of the anode holding body 6 and the inductance of wiring between the adjacent anodes Y is 0.08 μH. Incidentally, Steel Bars No. 1 to No. 10 correspond to the Works W1 to W10 in FIG. 1.

Figure 18:
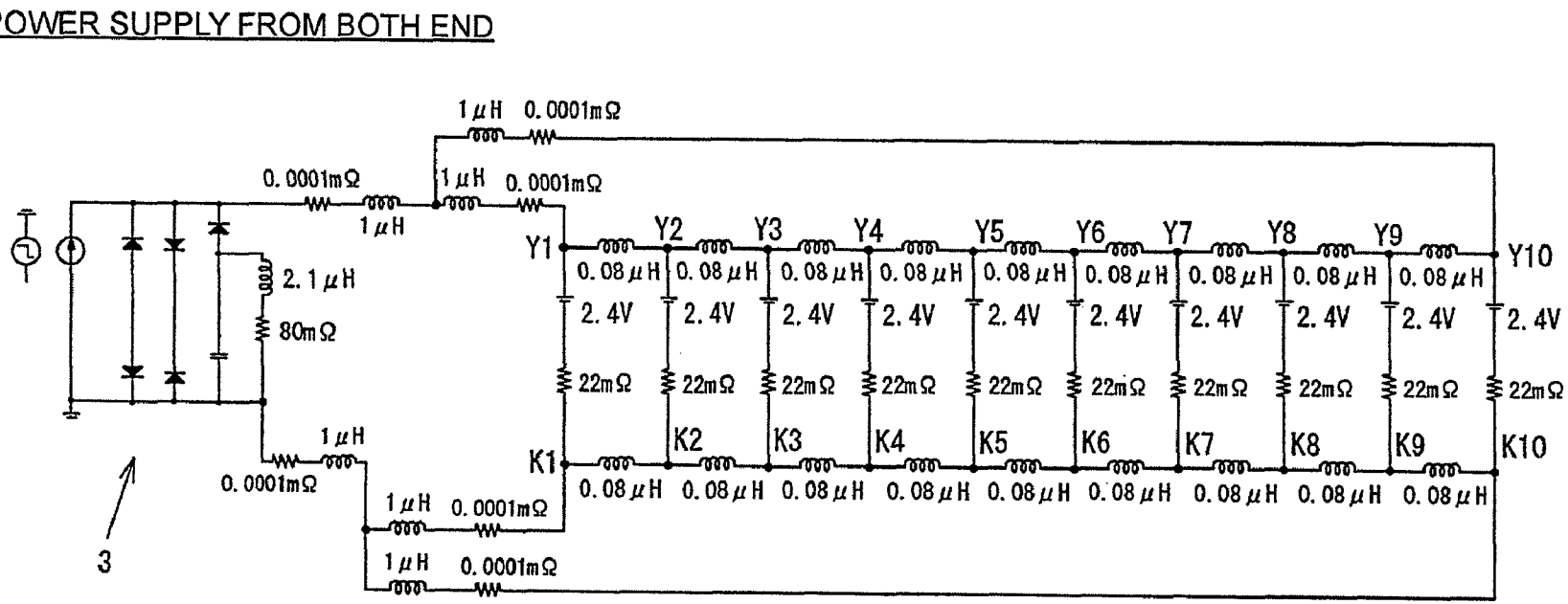
FIG. 18 is a circuit diagram which shows a simulation model of the chromium plating apparatus of FIGS. 17A and 17B.
Figure 19:
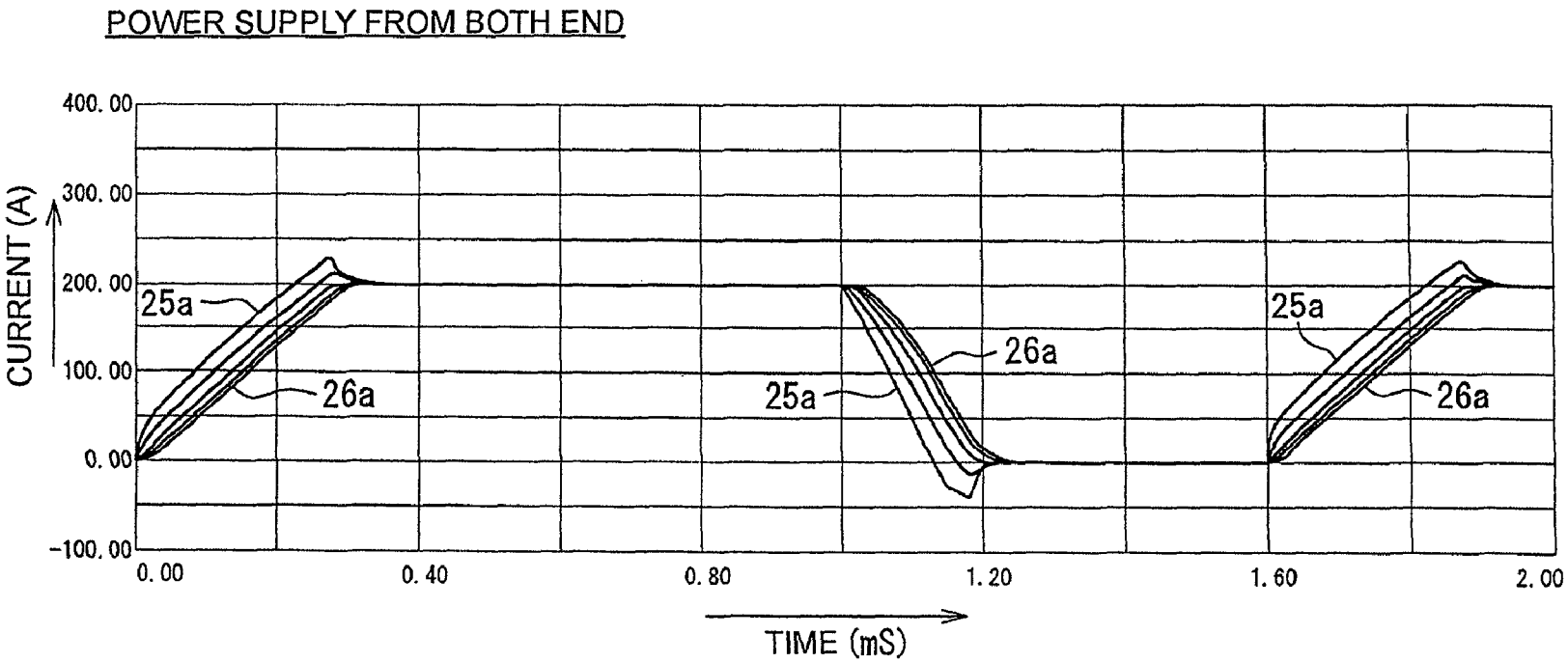
FIG. 19 is a waveform diagram which shows calculation results obtained in the simulation model of FIG. 18.

A simulation model (equivalent circuit) for calculating the waveform of a current flowing through each of the works W is shown in FIG. 18 and results of the calculations are shown in FIG. 19. As shown in FIG. 19, a pulse current flowing through works near the feeding point 8 has the waveform 25*a* and a pulse current flowing through works spaced from the feeding point 8 has the waveform 26*a*, with the result that a great deviation occurs at the leading edge and the trailing edge. Thus, different pulse currents flow through each work W, which is undesirable for plating treatment.

Comparative Example 2

Figure 20A:
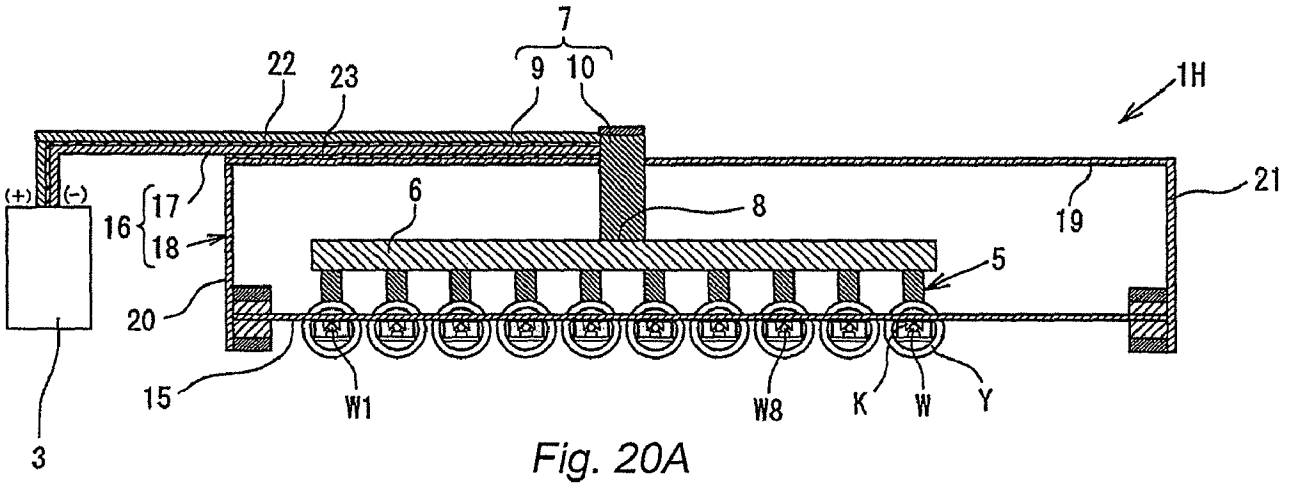
FIG. 20A is a plan sectional view which schematically shows a chromium plating apparatus used in Comparative Example 2.
Figure 20B:
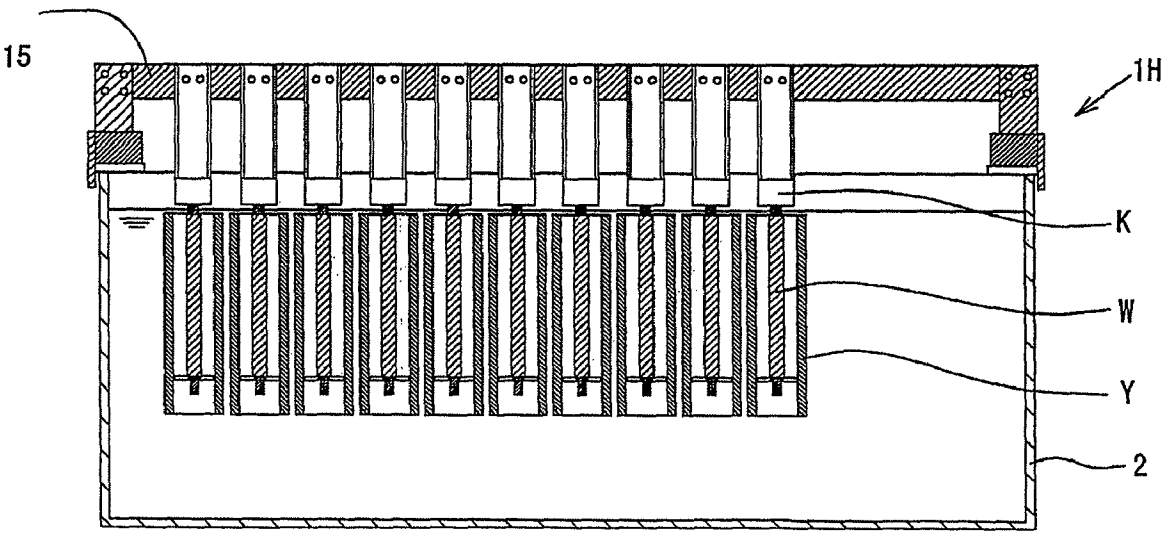
FIG. 20B is a front sectional view which schematically shows a chromium plating apparatus used in Comparative Example 2.

By use of the same chromium plating apparatus 1H shown in FIG. 20, the same test materials as used in Embodiment 1 were immersed in the same plating bath, pulse plating treatment was performed under the above-described embodiment conditions, and a chromium layer S1 (FIG. 6) having a thickness of about 10 μm was formed on the surface of each of the test materials. In the chromium plating apparatus 1H shown in FIG. 20, power is supplied from the middle part of the anode holding body 6, the inductance of wiring between the adjacent anodes Y is set constant, and the wiring shape is made different between the right and left sides of the figure (imbalance). Incidentally, Steel Bars No. 1 to No. 10 correspond to the Works W1 to W10 in FIG. 1.

Figure 21:
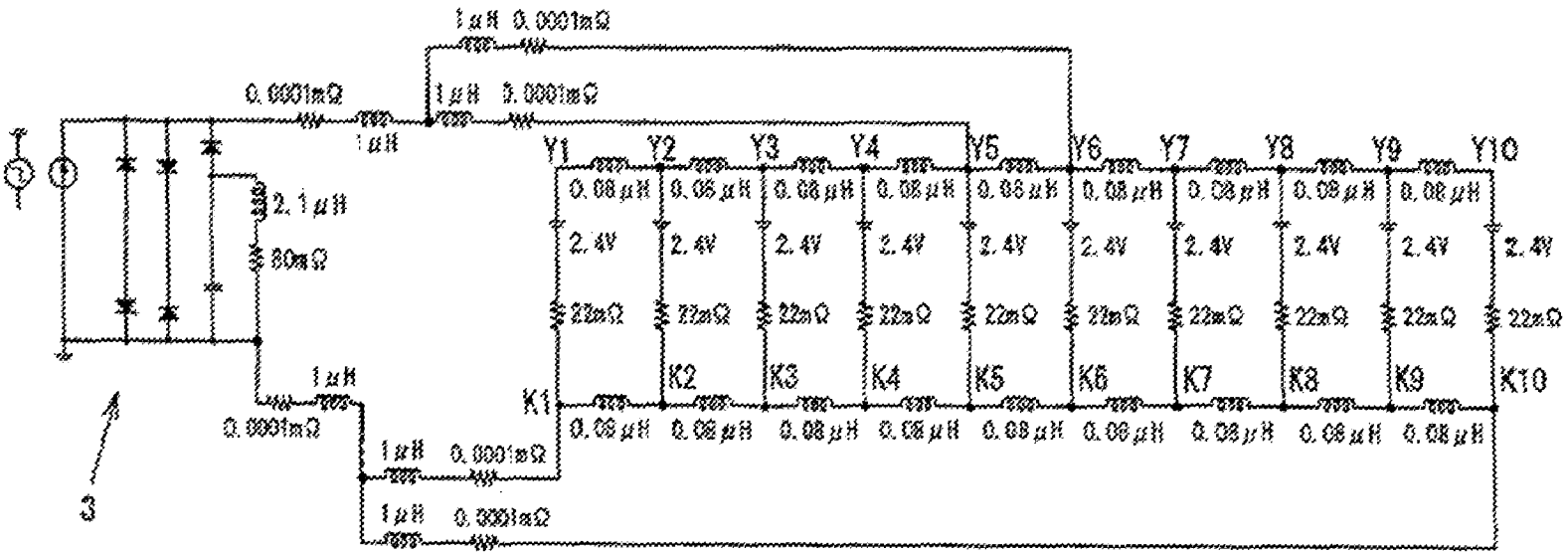
FIG. 21 is a circuit diagram which shows a simulation model of the chromium plating apparatus of FIGS. 20A and 20B.
Figure 22:
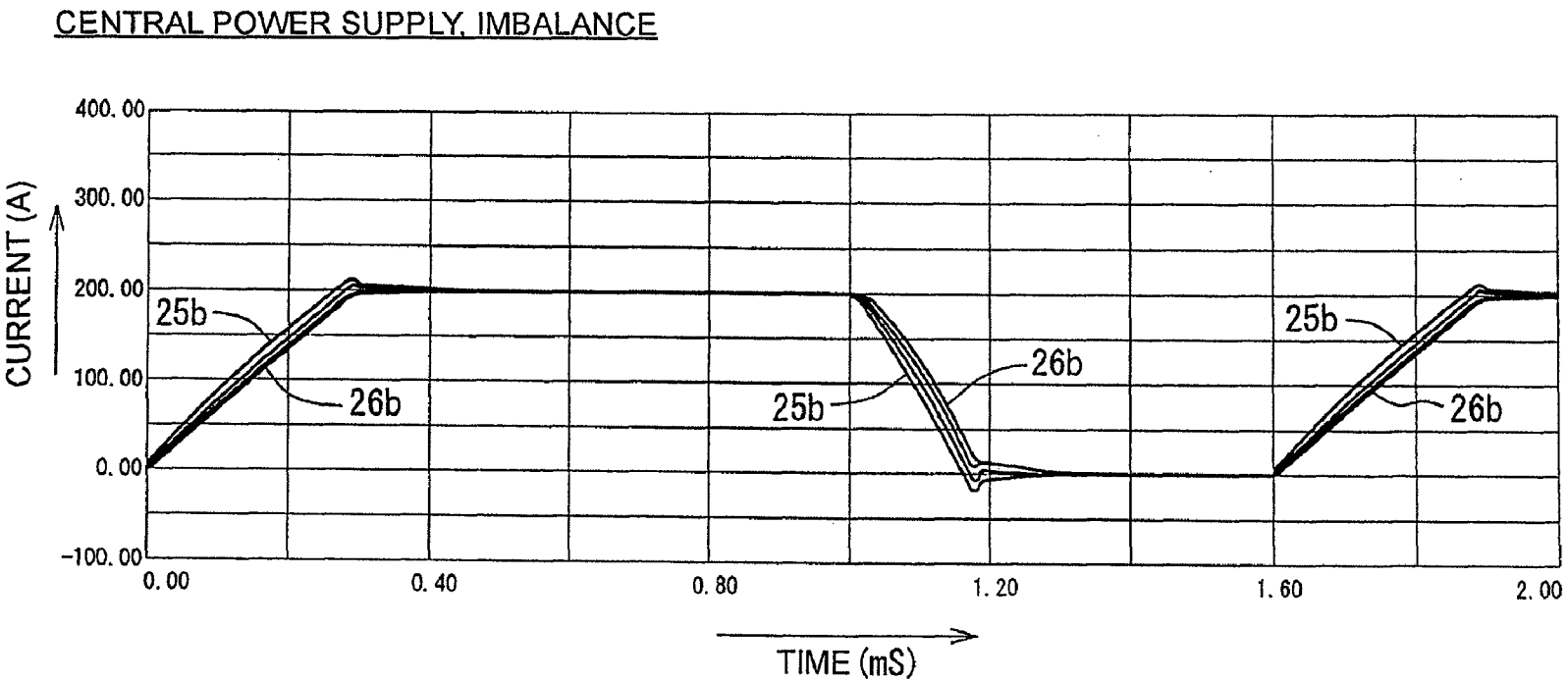
FIG. 22 is a waveform diagram which shows calculation results obtained in the simulation model of FIG. 21.
Figure 23A:
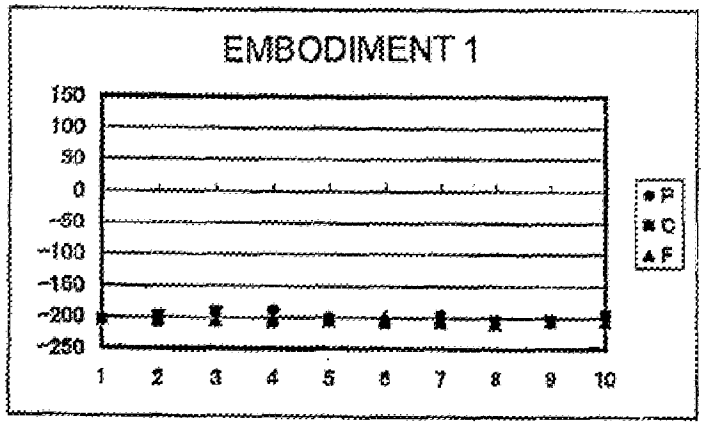
FIG. 23A is a graph which shows measurement results of residual stresses in Embodiment 1.
Figure 23B:
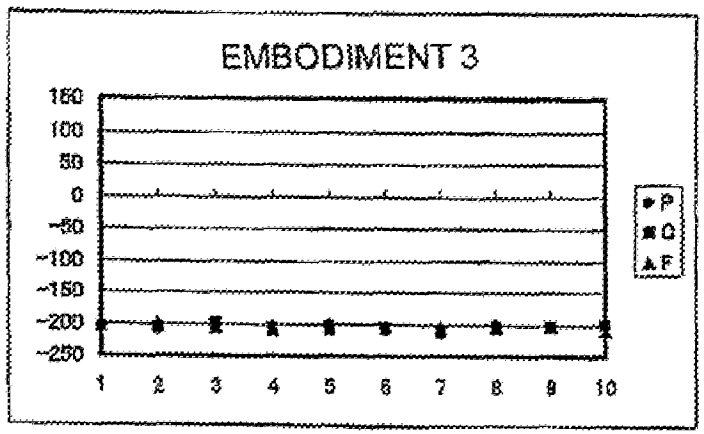
FIG. 23B is a graph which shows measurement results of residual stresses in Embodiment 3.
Figure 23C:
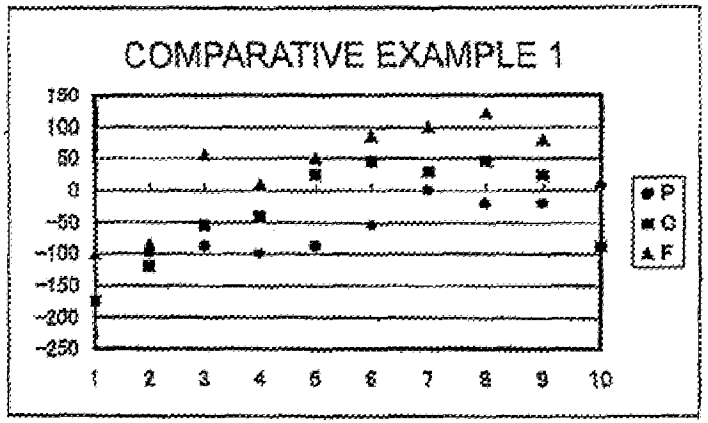
FIG. 23C is a graph which shows measurement results of residual stresses in Comparative Example 1.
Figure 23D:
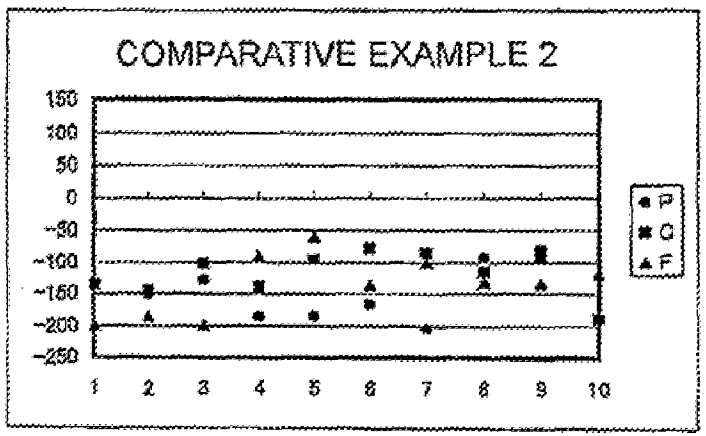
FIG. 23D is a graph which shows measurement results of residual stresses in Comparative Example 2.

A simulation model (equivalent circuit) for calculating the waveform of a current flowing through each of the works W is shown in FIG. 21 and results of the calculations are shown in FIG. 22. As shown in FIG. 22, a pulse current flowing through the work W1 has the waveform 25*b* and a pulse current flowing through the work W8 has the waveform 26*b*, with the result that a deviation occurs at the leading edge and the trailing edge. Thus, different pulse currents flow through each work W, which is undesirable for plating treatment.

Example of Test:

Each specimen obtained in Embodiments 1, 2 and 3 and Comparative Examples 1 and 2 described above was observed under a microscope to investigate whether cracks are present in the chromium layer S1. Furthermore, residual stresses of the chromium layer S1 were measured in the three portions of the upper part (P), middle part (C) and lower part (F) by the method described below. A salt spray test in accordance with JIS Z2371 was conducted for 1000 h to observe whether rusting had occurred. Specimens in which rusting had not been observed were subjected to heating treatment at 200° C. for 2 hours, and after the heating treatment, it was observed whether cracks are present in the chromium layer S1 in the same manner as described above, and a salt spray test was again conducted for 500 h.

The measurement of residual stresses in the chromium layer was carried out by using the X-ray stress measuring method disclosed in "Hihakai Kensa (non-destructive inspection)", vol. 37, item 8, pages 636 to 642, edited by the Japanese Society for Non-destructive Inspection.

The measuring results of the residual stresses in Embodiments 1 and 3 and Comparative Examples 1 and 2 described above are collectively shown in FIGS. 23A to 23D. In the diagrams showing the measuring results, Steel Bars No. 1 to No. 10 (works W) which were measured are taken as abscissa and residual stress [MPa] is taken as ordinate. The upper part (P), middle part (C) and lower part (F) in each specimen are respectively denoted by black circles, black squares and black triangles.

From the results shown in FIGS. 23A to 23D, it is apparent that high residual stresses of not less than 100 MPa are present in Embodiments 1 and 3 and that the values of residual stresses are almost the same in Steel Bars No. 1 to No. 10. In contrast, in Comparative Examples 1 and 2, the values differ greatly in Steel Bars No. 1 to No. 10, whereas there are many steel bars in which low compressive residual stresses of not more than 100 MPa are observed (this tendency is remarkable in Comparative Example 1). This is undesirable for plating treatment.

The entire disclosures of U.K. Patent Application Disclosure No. 2,236,763 (Japanese Patent Application Japanese Patent Application Disclosure No. 3-207884), U.S. Pat. No. 6,329,071 (Japanese Patent Application Disclosure No. 2000-199095), U.S. Pat. No. 4,588,481 (Examined Japanese Patent Application Disclosure No. 63-32874) and "Hihakai Kensa (non-destructive inspection)", vol. 37, item 8, pages 636 to 642, edited by the Japanese Society for Non-destructive Inspection are incorporated herein by reference in their entirety.

It should be understood that the present invention is not limited to the plurality of embodiments described above and the embodiments may be modified in various manners without departing from the spirit of the present invention.

What is claimed is:

1. A method of manufacturing a chromium plated article comprising:

immersing a plurality of works in a chromium plating bath; and depositing a chromium layer having a desired compressive residual stress on a surface of each of the works by using a pulse current;

wherein a waveform of the pulse current supplied to each of the works is made substantially uniform irrespective of the works by adjusting inductance of a wiring from a pulse power source to each of the works, wherein the works are disposed in an apparatus which comprises a plurality of anodes and a plurality of cathodes disposed in such a manner as to correspond to each of the plurality of works, an anode holding body which is connected sequentially to the plurality of anodes and is connected to a positive pole of a pulse power source, and a cathode holding body which is connected sequentially to the plurality of cathodes and is connected to a negative pole of the pulse power source; and wherein chromium plating is performed, with the pulse power source connected to a middle part of one of the anode holding body and the cathode holding body, and the pulse power source connected to both ends of the other of the anode holding body and the cathode holding body, and wherein at least one of the anode holding body and the cathode holding body has inductances of wiring between adjacent ones of the plurality of the anodes or the plurality of the cathodes, which increase with increasing distance from a connection with the pulse power source.

2. The method of manufacturing a chromium plated article according to claim 1, wherein inductances between the plurality of electrodes are set at a ratio of 1:2:3: . . . sequentially, in a direction of spacing from the connection with the pulse power source.

3. The method of manufacturing a chromium plated article according to claim 1, wherein each of the plurality of anodes is cylindrical, and each of the works connected to the plurality of cathodes is inserted into each of the plurality of anodes.

4. The method of manufacturing a chromium plated article according to claim 1, wherein each of the works is arranged in one row at a prescribed spacing, and the anodes are disposed in multiple pairs in a face-to-face relation, with each of the works interposed therebetween.

5. The method of manufacturing a chromium plated article according to claim 4, wherein the anode holding body includes a first anode holding part on a first side and a second anode holding part on a second side, and the plurality of anodes includes a first anode group on the first side and a second anode group on the second side, and wherein the first anode holding part on the first side and the second anode holding part on the second side are respectively provided in positions below or above the first anode group on the first side and the second anode group on the second side, and the plurality of cathodes are provided in positions below or above the works.

6. The method of manufacturing a chromium plated article according to claim 1, wherein the inductance between the plurality of cathodes of the cathode holding body is twice as large as the inductance between the plurality of anodes of the anode holding body.

7. A chromium plating apparatus which immerses a plurality of works in a chromium plating bath and deposits a chromium layer having a desired compressive residual stress on a surface of the works by using a pulse current, wherein inductance of a wiring from a pulse power source to each of the works is set so that a waveform of the pulse current supplied to each of the works is made substantially uniform irrespective of the works, the chromium plating apparatus comprising:

a plurality of anodes and a plurality of cathodes disposed in such a manner as to correspond to the plurality of works;

an anode holding body connected sequentially to the plurality of anodes and connected to a positive pole of the pulse power source; and a cathode holding body connected sequentially to the plurality of cathodes and connected to a negative pole of the pulse power source, wherein the pulse power source is connected to a middle part of one of the anode holding body and the cathode holding body, and the pulse power source being connected to both ends of the other of the anode holding body and the cathode holding body, and wherein at least one of the anode holding body and the cathode holding body has inductances of wiring between adjacent ones of the plurality of the anodes or the plurality of the cathodes, which increase with increasing distance from a connection with the pulse power source.

8. The chromium plating apparatus according to claim 7, wherein inductances between the plurality of electrodes are set at a ratio of 1:2:3: . . . sequentially, in a direction of spacing from the connection with the pulse power source.

9. The chromium plating apparatus according to claim 7, wherein each of the plurality of anodes is cylindrical, and each of the works connected to the plurality of cathodes is inserted into each of the plurality of anodes.

10. The chromium plating apparatus according to claim 7, wherein each of the plurality of works is arranged in one row at a prescribed spacing, and the anodes are disposed in a plurality of pairs in a face-to-face relation, with each of the works interposed therebetween.

11. The chromium plating apparatus according to claim 10, wherein the anode holding body includes a first anode holding part on a first side and a second anode holding part on a second side, and the plurality of anodes includes a first anode group on the first side and a second anode group on the second side, and wherein the first anode holding part on the first side and the second anode holding part on the second side are respectively provided in positions below or above the first anode group on the first side and the second anode group on the second side, and the plurality of cathodes are provided in positions below or above the works.

12. The chromium plating apparatus according to claim 7, wherein the inductance between the plurality of cathodes of the cathode holding body is twice as large as the inductance between the plurality of anodes of the anode holding body.

* * * * *